US010068413B2

(12) United States Patent
Meyer

(10) Patent No.: US 10,068,413 B2
(45) Date of Patent: Sep. 4, 2018

(54) ELECTRONIC GAMING MACHINE AND GAMING METHOD

(71) Applicant: Ainsworth Game Technology Limited, Newington (AU)

(72) Inventor: Jason Meyer, Abbotsford (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 287 days.

(21) Appl. No.: 14/689,768

(22) Filed: Apr. 17, 2015

(65) Prior Publication Data

US 2016/0247361 A1 Aug. 25, 2016

(30) Foreign Application Priority Data

Feb. 20, 2015 (AU) ..... 2015200885

(51) Int. Cl.
*G07F 17/32* (2006.01)

(52) U.S. Cl.
CPC ..... *G07F 17/3213* (2013.01); *G07F 17/3225* (2013.01)

(58) Field of Classification Search
CPC ... G07F 17/3213; G07F 17/3258; G07F 17/34
See application file for complete search history.

(56) References Cited

U.S. PATENT DOCUMENTS 4,695,053 A * 9/1987 Vazquez, Jr. ..... G07F 17/3262 273/143 R
5,580,053 A * 12/1996 Crouch ..... G07F 17/34 463/20
2004/0092300 A1* 5/2004 Gauselmann ..... G07F 17/32 463/16
2005/0096121 A1* 5/2005 Gilliland ..... G07F 17/32 463/20
2006/0160613 A1* 7/2006 Hornik ..... G07F 17/32 463/25
2008/0064477 A1* 3/2008 Fong ..... G07F 17/3223 463/20
2008/0081688 A1* 4/2008 Plowman ..... G07F 17/34 463/20
2009/0156287 A1* 6/2009 Baumgartner ..... G07F 17/34 463/20
2009/0191943 A1* 7/2009 Visser ..... G07F 17/32 463/20

(Continued)

FOREIGN PATENT DOCUMENTS

WO WO 96/08799 3/1996

*Primary Examiner* — Omkar Deodhar
*Assistant Examiner* — Shauna-Kay Hall
(74) *Attorney, Agent, or Firm* — Cook Alex Ltd.

(57) ABSTRACT

An electronic gaming machine comprises a display for displaying a game and an electronic game controller for controlling the display of game symbols on the display. The electronic game controller enables the player to select a bet option from a plurality of bet options. A first bet option has a first number of predetermined combinations of symbol positions and a second bet option has a second number of predetermined combinations of symbol positions. The first and second bet options and the first and second numbers are different to each other. In response to an in-game trigger event, the number of symbol positions in the array changes based on the selected bet option. A gaming method is also provided.

25 Claims, 12 Drawing Sheets

(56) References Cited

U.S. PATENT DOCUMENTS

| | | | | |
|---|---|---|---|---|
| 2010/0203948 | A1 | 8/2010 | Falciglia, Sr. | |
| 2012/0122545 | A1* | 5/2012 | Watkins | G07F 17/3211 463/20 |
| 2013/0150142 | A1* | 6/2013 | Caputo | G07F 17/3265 463/20 |
| 2014/0094263 | A1 | 4/2014 | Johnson et al. | |

* cited by examiner

ELECTRONIC GAMING MACHINE AND GAMING METHOD

BACKGROUND

The present invention relates to an electronic gaming machine and in a particular an electronic gaming machine using a base game and a feature game. The invention has been developed primarily for use as an electronic gaming machine and will be described hereinafter by reference to this application.

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

Bonus or "feature" games may also be provided by an electronic gaming machine in addition to a base or main game. Typically feature games use the same set of reels as the main game and are limited to a set of free games operated under a single set of rules. This means that the feature game is restricted by the same set of rules, and so there is no variation in the play of the feature game.

Also, electronic gaming machines can offer one or more bonus prizes to the player during play of the game. The most common type of bonus prize that is awarded by the electronic gaming machine is a jackpot prize, the main example of which is a progressive jackpot prize.

This standard structure to game play and bonus prizes limits the variation in the play of the electronic gaming machine. Consequently, it is difficult to retain player interest because there is no apparent incentive for the player to continue playing the same electronic gaming machine once the player becomes familiar with the feature game, the main game and any bonus prizes. Also, it is difficult to retain player interest since there is little differentiation between gaming machines in terms of the main and feature games that are played.

It is an object of the present invention to overcome or substantially ameliorate one or more of the disadvantages of prior art, or at least to provide a useful alternative.

SUMMARY

According to a first aspect of the invention, there is provided an electronic gaming machine comprising:

a display for displaying a game, wherein said game comprises game symbols arranged in an array of symbol positions and predetermined winning combinations of randomly selected game symbols award prizes to a player; and an electronic game controller for controlling the display of said game symbols on said display;

wherein said electronic game controller enables said player to select a bet option from a plurality of bet options for said game, each said bet option being associated with a number of predetermined combinations of symbol positions defined in said array;

wherein a first bet option is associated with a first number of predetermined combinations of symbol positions and a second bet option is associated with a second number of predetermined combinations of symbol positions, said first bet option being different to said second bet option and said first number being different to said second number; and in response to an in-game trigger event, the number of symbol positions displayed in said array changes based on the selected bet option.

Preferably, the number of symbol positions displayed in said array increases by the addition of new symbol positions on said display. More preferably, the number of new symbol positions associated with said first bet option is less than the number of new symbol positions associated with said second bet option. In some embodiments, the number of new symbol positions associated with said first bet option is less than the number of new symbol positions associated with said second bet option. In other embodiments, one or more new predetermined combinations are formed on said array in addition to the predetermined combinations associated with said bet options, said one or more new predetermined combinations comprising one or more of said new symbol positions. Alternatively, one or more new predetermined combinations are formed on said array in addition to the predetermined combinations associated with said bet options, said one or more new predetermined combinations comprising only said new symbol positions.

Preferably, said first bet option has a value less than a value of said second bet option.

Preferably, said first number of predetermined combinations of symbol positions that is less than said second number of predetermined combinations of symbol positions.

Preferably, the number of symbol positions in said array for said first bet option is different to the number of symbol positions in said array for said second bet option. More preferably, the number of symbol positions in said array for said first bet option is less than the number of symbol positions in said array for said second bet option.

Preferably, for at least one of said first and second bet options, each symbol position in said array is used in at least one predetermined combination of symbol positions. In some embodiments, for said first bet option, each symbol position in said array is used in at least one predetermined combination of symbol positions. In other embodiments, for said second bet option, each symbol position in said array is used in at least one predetermined combination of symbol positions.

Preferably, said array for said first bet option is different in shape to said array for said second bet option. More preferably, said array for one of said first and second bet options has a non-rectangular shape.

Preferably, said array changes in shape in response to said in-game trigger event. In some embodiments, said array changes from a rectangular shape to a non-rectangular shape. In other embodiments, said array changes from a non-rectangular shape to a rectangular shape.

Preferably, the symbol positions of each said bet option are arranged in said array differently to the symbol positions in said array for the other bet options.

Preferably, said array is solely used to play said game.

Preferably, said array comprises symbol positions arranged into columns or reels associated with reel strips comprising game symbols for display on said reels, wherein at least one reel strip associated with said array for said first bet option is different to at least one reel strip associated with said array for said second bet option. More preferably, the reel strips associated with said array for said first bet option are different to the reel strips associated with said array for said second bet option.

Preferably, the game rules for playing said array for said first bet option are different to the game rules for playing said array for said second bet option.

Preferably, the pay table for predetermined winning combinations of game symbols displayed on said array for said first bet option is different to the pay table for predetermined winning combinations of game symbols displayed on said array for said second bet option.

Preferably, special symbols become available for display in the same game depending on the selected bet option.

Preferably, said in-game trigger event comprises the appearance of one or more special symbols on said array. More preferably, said in-game trigger event occurs in a preceding play of said game and said array only displays the symbol positions associated with a selected bet option in a subsequent play of said game. In one embodiment, said subsequent play is the play of the game after said preceding play. Alternatively or additionally, said in-game trigger event is randomly determined by said electronic game controller. More preferably, said in-game trigger event is determined by said electronic game controller at the end of said preceding play. Alternatively, said in-game trigger event is determined by said electronic game controller during said preceding play.

Preferably, said array is different when displaying the symbol positions associated with said first bet option in said array compared to when said array displays the symbol positions associated with said second bet option.

Preferably, said game comprises a base game and a feature game. More preferably, said game symbols in said feature game and said base game are arranged in arrays of the same shape or type. Alternatively, said game symbols in said feature game and said base game are arranged in differently shaped arrays. The shapes of said arrays are preferably rectangular, circular, triangular, oval, semi-circular or other non-rectangular shape.

Preferably, said electronic game controller causes the display of said feature game in response to a trigger event in said base game. Alternatively, said electronic game controller causes the display of said feature game and said base game during play of said base game, said feature game being inactive until triggered. In this embodiment, the change in said feature game from being inactive to active may be indicated on the display.

Preferably, said game comprises said game symbols arranged in a plurality of symbol or game positions in said array. More preferably, said array comprises one or more rows and/or columns of said symbol positions. In one embodiment, said array comprises a plurality of reels.

Preferably, the player selectively starts and/or stops play of said reels in said array in said game, being the base game and/or feature game.

Preferably, said electronic gaming machine comprises a housing having said display and containing said electronic game controller.

Preferably, said electronic gaming machine comprises an input device. It is also preferred that said input device is arranged on said housing. In one embodiment, said input device comprises one or more buttons on said housing, said buttons being in electronic communication with said electronic game controller to transmit player commands to said electronic game controller. More preferably, said buttons are arranged on a console of said housing. Alternatively or additionally, said input device comprises a touch sensitive surface on said display for receiving player commands, said touch sensitive surface being in electronic communication with said electronic game controller to transmit player commands to said electronic game controller.

Preferably, electronic gaming machine comprises a value transfer mechanism for paying said prizes to said player using value in an amount equal to an awarded prize. Alternatively or additionally, said value transfer mechanism receives value from said player to make said bet and initiate play of said game. More preferably, said value transfer mechanism is in electronic communication with said electronic game controller. It is also preferred that said value transfer mechanism is provided on said housing. In one embodiment, said value transfer mechanism comprises one or more vending slots for paying and/or receiving value. In other embodiments, said value transfer mechanism comprises a value input/value output device. In further embodiments, said value transfer mechanism comprises a coin slot or acceptor, a paper currency acceptor, a ticket reader and/or printer or a card reader and/or writer.

Throughout the specification and unless explicitly stated otherwise, the term "value" means money denominations, credits, gaming tokens, coins, paper, currency, tickets, vouchers (both physical and electronic), credit cards, debit cards, smart cards, memory devices capable of storing value and any other object representative of value.

Preferably, the electronic gaming machine comprises a mobile electronic gaming device. More preferably, said mobile electronic gaming device comprises a handheld electronic device. Alternatively, said electronic gaming machine comprises a computer. More preferably, said computer is connected to a communication network.

A second aspect of the present invention provides an electronic gaming machine comprising:

a display for displaying game symbols for playing a game, wherein said game comprises randomly displaying said game symbols in an array of symbol positions and awarding prizes to a player for predetermined winning combinations of game symbols to a player;

an electronic game controller in electronic communication with said display for controlling the appearance of game symbols in said game on the display; and a value transfer mechanism for receiving value from a player to make a bet and initiate play of said game on said display, said value transfer mechanism being in electronic communication with said electronic game controller;

wherein said electronic game controller in response to said player making a bet via said value transfer mechanism commences play of said game by randomly selecting game symbols and transmitting a signal to said display to display said randomly selected game symbols;

wherein said electronic game controller enables said player to select a bet option from a plurality of bet options for said game, each said bet option being associated with a number of predetermined combinations of symbol positions defined in an array;

wherein a first bet option is associated with a first number of predetermined combinations of symbol positions and a second bet option is associated with a second number of predetermined combinations of symbol positions, said first bet option being different to said second bet option and said first number being different to said second number; and wherein, in response to an in-game trigger event, said electronic game controller transmits a signal to said display so that the number of symbol positions displayed in said array changes based on the selected bet option.

This second aspect of the invention preferably has the preferred features of the first aspect of the invention stated above, where applicable.

According to a third aspect of the invention, there is provided a gaming method for an electronic gaming machine comprising a display and an electronic game controller, the method comprising the steps of:

controllably displaying game symbols for playing a game, wherein said game comprises game symbols arranged in an array of symbol positions and predetermined winning combinations of randomly selected game symbols award prizes to a player;

enabling said player to select a bet option from a plurality of bet options for said game, each said bet option being associated with a number of predetermined combinations of symbol positions defined in said array;

associating a first bet option with a first number of predetermined combinations of symbol positions;

associating a second bet option is associated with a second number of predetermined combinations of symbol positions;

making said first bet option different to said second bet option;

making said first number different to said second number; and changing the number of symbol positions displayed in said array based on the selected bet option in response to an in-game trigger event.

Preferably, said method comprises increasing the number of symbol positions displayed in said array by the adding new symbol positions on said display. More preferably, the number of new symbol positions associated with said first bet option is less than the number of new symbol positions associated with said second bet option. In some embodiments, the number of new symbol positions associated with said first bet option is less than the number of new symbol positions associated with said second bet option. In other embodiments, one or more new predetermined combinations are formed on said array in addition to the predetermined combinations associated with said bet options, said one or more new predetermined combinations comprising one or more of said new symbol positions. Alternatively, one or more new predetermined combinations are formed on said array in addition to the predetermined combinations associated with said bet options, said one or more new predetermined combinations comprising only said new symbol positions.

Preferably, said method comprises providing said first bet option with a value less than a value of said second bet option.

Preferably, said method comprises making said first number of predetermined combinations of symbol positions less than said second number of predetermined combinations of symbol positions.

Preferably, said method comprises making the number of symbol positions in said array for said first bet option different to the number of symbol positions in said array for said second bet option. More preferably, said method comprises making the number of symbol positions in said array for said first bet option less than the number of symbol positions in said array for said second bet option.

Preferably, said method comprises using, for said first bet option, each symbol position in said array in at least one predetermined combination of symbol positions. Preferably, said method comprises using, for said second bet option, each symbol position in said array in at least one predetermined combination of symbol positions.

Preferably, said method comprises making said array for said first bet option array different in shape to said array for said second bet option. More preferably, said array has a non-rectangular shape for one of said first and second bet options.

Preferably, said method comprises arranging the symbol positions in said array for each said bet option differently to the symbol positions in said array for the other bet options.

Preferably, said method comprises solely using said array to play said game.

Preferably, said method comprises arranging the symbol positions of said array into columns or reels associated with reel strips comprising game symbols for display on said reels, and providing at least one reel strip associated with said array for said first bet option that is different to at least one reel strip associated with said array for said second bet option. More preferably, said method comprises providing the reel strips associated with said array for said first bet option to be different to the reel strips associated with said array for said second bet option.

Preferably, said method comprises providing game rules for playing said array for said first bet option that are different to the game rules for playing said array for said first bet option.

Preferably, said method comprises providing a pay table for predetermined winning combinations of game symbols displayed on said array for said first bet option that is different to a pay table for predetermined winning combinations of game symbols displayed on said array for said first bet option.

Preferably, said method comprises making special symbols become available for display in the same game depending on the selected bet option.

Preferably, said method comprises making said array different when displaying the symbol positions associated with said first bet option in said array compared to when said array displays the symbol positions associated with said second bet option. In some embodiments, said electronic game controller transmits a signal to said display so that said array is different on said display when said array displays the symbol positions associated with said first bet option compared to when said array displays the symbol positions associated with said second bet option.

The method preferably has the preferred features of the first aspect of the invention where applicable.

A fourth aspect of the present invention provides a gaming method for an electronic gaming machine comprising a display for displaying a game, wherein said game comprises game symbols arranged in an array of symbol positions and predetermined winning combinations of randomly selected game symbols in said game award prizes to a player; an electronic game controller for controlling the display of said game symbols for playing said game on said display; and a value transfer mechanism for receiving value from a player to make a bet and initiate play of said game on said display, said value transfer mechanism being in electronic communication with said electronic game controller, the method comprising:

said electronic gaming machine receiving said bet from said player via said value transfer mechanism to initiate play of said game on said display;

said electronic game controller enabling said player to select a bet option from a plurality of bet options for said game, each said bet option being associated with a number of predetermined combinations of symbol positions defined in said array;

said electronic game controller associating a first bet option with a first number of predetermined combinations of symbol positions and associating a second bet option is associated with a second number of predetermined combinations of symbol positions;

said electronic game controller making said first bet option different to said second bet option and making said first number different to said second number; and said electronic game controller, in response to an in-game trigger event, transmitting a signal to said display to change the number of symbol positions displayed in said array based on the selected bet option.

The method of the fourth aspect of the invention preferably has the preferred features of the third aspect of the invention stated above, where applicable.

According to a fifth aspect of the invention, there is provided a computer system comprising a central processing unit configured for communication with an electronic gaming machine, wherein said computer system is configured to perform the method of the third or fourth aspects of the invention.

According to a sixth aspect of the invention, there is provided a computer programme configured to perform the method of the third or fourth aspects of the invention.

According to a seventh aspect of the invention, there is provided a non-transitory carrier medium carrying computer executable code that, when executed on a central processing unit configured for communication with an electronic gaming machine, causes the central processing unit to perform the method of the third or fourth aspects of the invention.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

Preferred embodiments of the invention will now be described, by way of example only, with reference to the accompanying drawings in which.

DETAILED DESCRIPTION OF VARIOUS EMBODIMENTS

Figure 1:
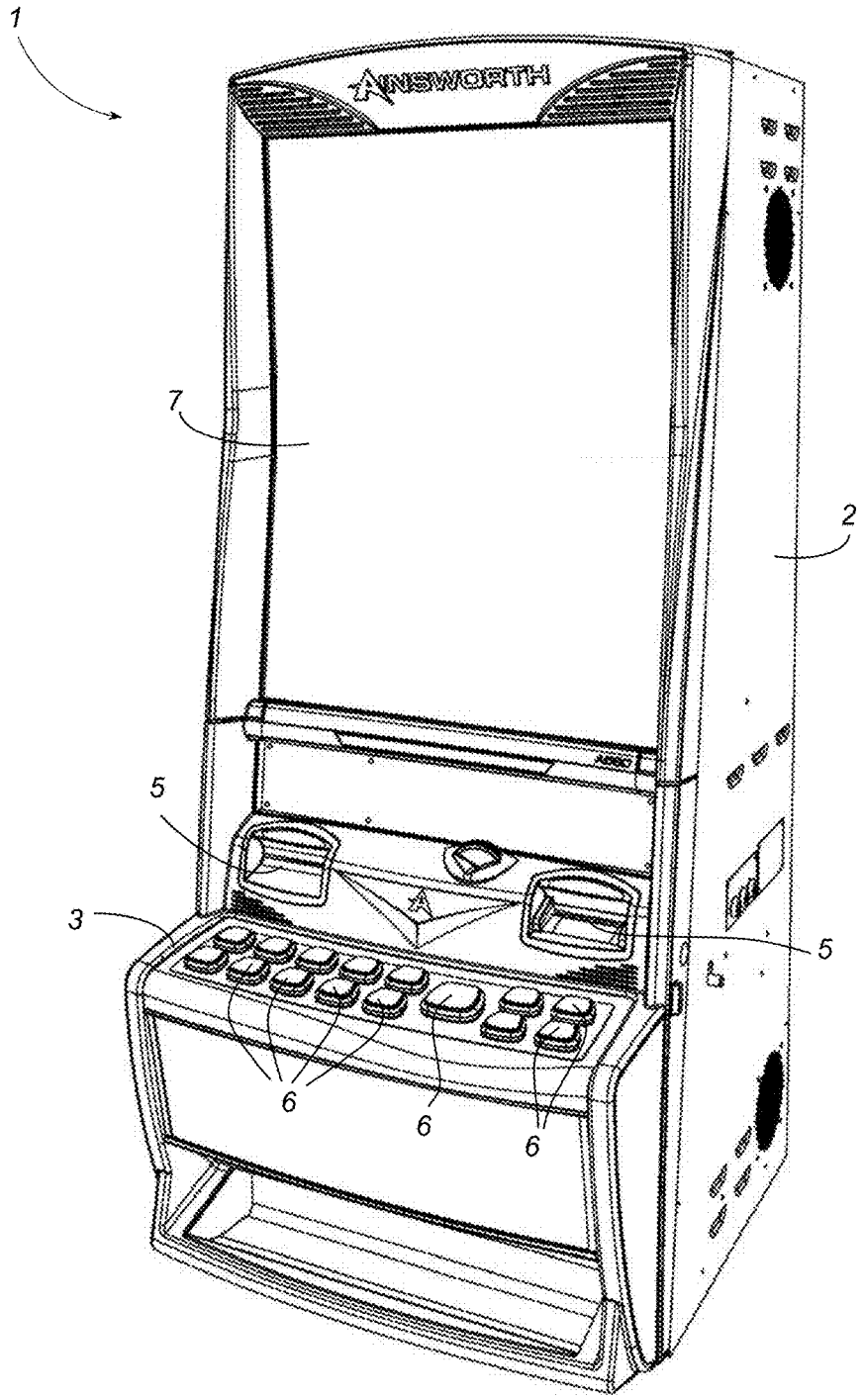
FIG. 1 is a perspective view of an electronic gaming machine according to an embodiment of the invention.

The present invention will now be described with reference to the following examples which should be considered in all respects as illustrative and non-restrictive. In the Figures, corresponding features within the same embodiment or common to different embodiments have been given the same reference numerals.

Referring to FIG. 1, an electronic gaming machine 1 according to a first embodiment of the invention includes a cabinet 2, a console 3 and an internal electronic game controller 4. The console 3 has various input devices including vending slots 5 for receiving monetary bets and a plurality of buttons 6 for actuation by a player. It will be appreciated that in other embodiments the vending slots 5 may be replaced with other types of value input/value output devices, such as a coin acceptor, a paper currency acceptor, a ticket reader and/or printer or a card reader and/or writer.

The vending slots 5 can be configured to receive value, such as cash in the form of banknotes and coins, or credits representing a monetary amount from a memory device, such as but not limited to a memory card, smart card, a radio frequency identification (RFID) device, USB key, magnetic card or other electronic storage device. Typically, the memory device is a credit card, debit card or other card that enables the transfer of monetary credit to the electronic gaming machine 1. Other forms of value include gaming tokens, paper, tickets, vouchers, and any other object representative of value.

Figure 2:
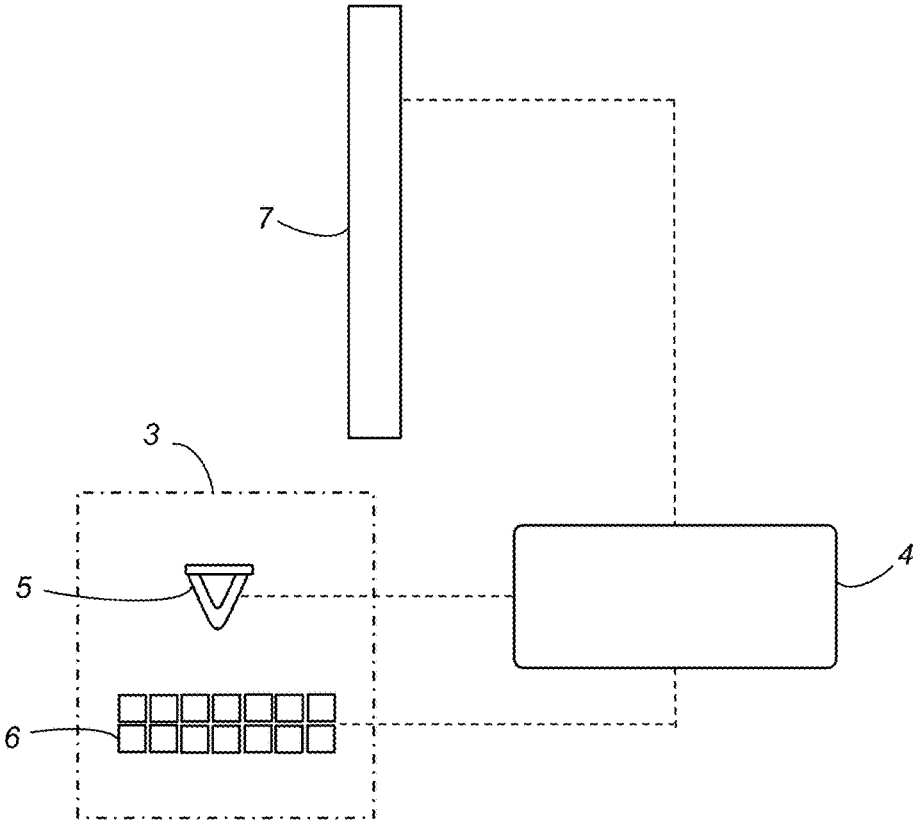
FIG. 2 is a schematic drawing of an electronic game controller for the electronic gaming machine of FIG. 1.

The electronic game controller 4 is generally in the form of a central processing unit, such as a computer, and is in electronic communication with a display in the form of a video display screen 7, as well as various input devices on the console 3, as best shown in FIG. 2. Typically, the electronic game controller 4 also comprises a random access memory (RAM) associated with the central processing unit, the RAM being used to store programme instructions and transient data related to the operation of the electronic game controller and hence the electronic gaming machine 1. The RAM contains a body of program instructions for implementing a game on the electronic gaming machine 1, as discussed in more detail below. The central processing unit or processor may also be operatively associated with a further storage device, such as a hard disk drive, which is used for long-term storage of program components and data relating to the electronic game controller 4 and/or the electronic gaming machine 1, including a database for game performance data, as well as information gathered from users. It is also appreciated that a person skilled in the art would readily understand the location and use of the electronic game controller 4 in the electronic gaming machine 1.

The electronic game controller 4 will transmit and receive signals to and from each of the input devices and the display 7, usually via wired connections but can include wireless modes of electronic communication, such as WLAN. In the case of the vending slots 5 (or with any other type of value transfer mechanism), there may be an intermediate credit verification device that examines and verifies the cash or credits received by the vending slots. Once the value (such as cash or credits) have been verified by the credit verification device, a signal is sent to the electronic game controller 4, which then determines whether the minimum bet level has been reached. If so, the electronic game controller 4 will permits play of the game on the electronic gaming machine 1. If not, the electronic game controller 4 will send a signal to the display 7 to show a message requesting further value to be added to the electronic gaming machine 1.

Figure 3:
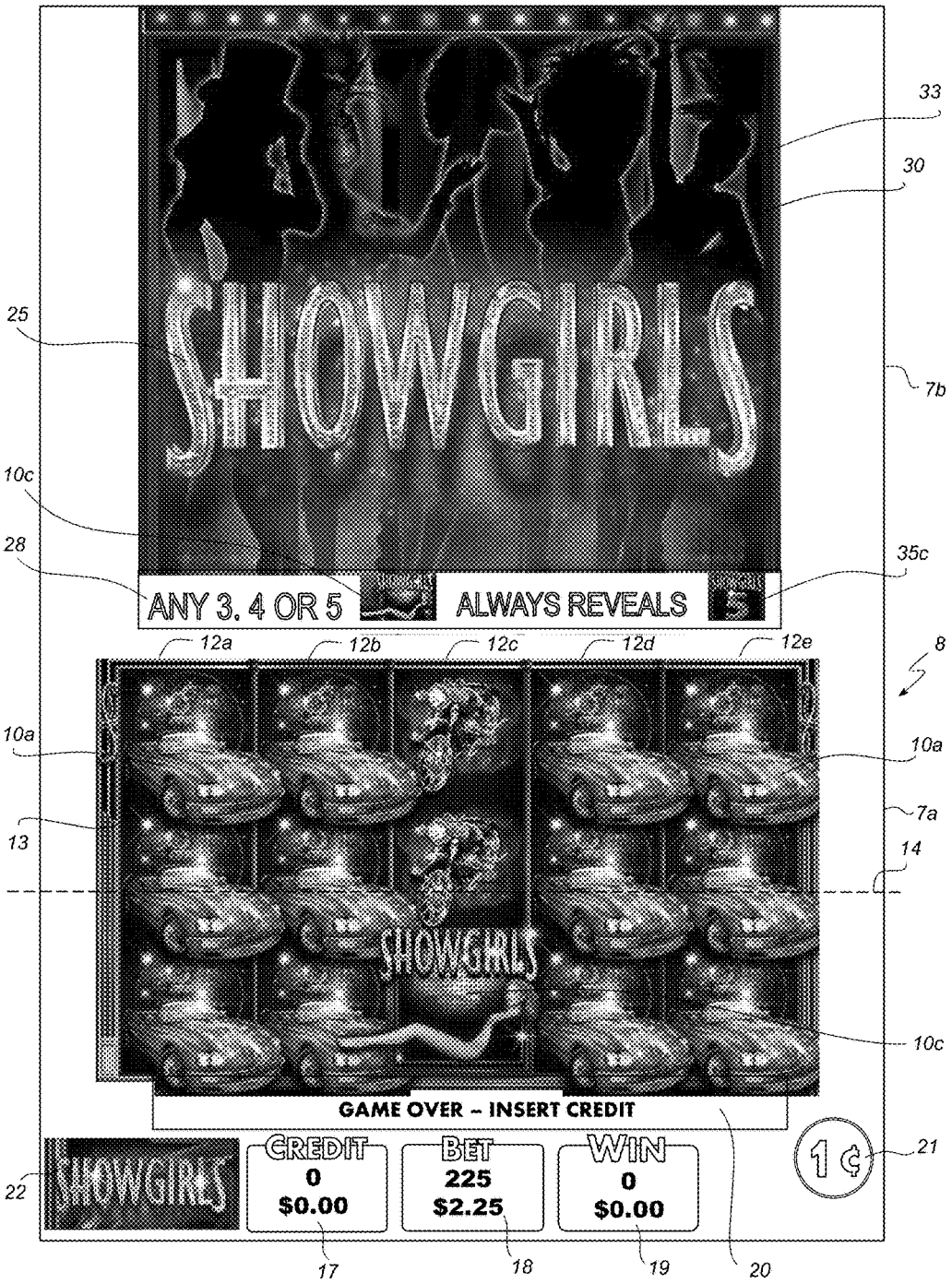
FIG. 3 is a simulated screen shot illustrating a base game played on the electronic gaming machine of FIG. 1.

The electronic game controller 4 is programmed to provide a game in the form of a base game 8 (as best shown in FIG. 3) and a feature game 9 (now shown) on the display 7 of the electronic gaming machine 1 for play by a player. The base game 8 has game symbols 10 arranged into an array 11 in the form of five columns or "reels" 12. The reels 12 give the visual appearance of rotating, typically by having the game symbols 10 move in a downward linear path along the length of each reel 12. The array 11 is arranged with five reels 12 and three rows as per the industry standard, it will be appreciated by one skilled in the art that other types of arrays could be used, such as 3×3, 4×3, 5×5, 4×4, etc, including arrays having an irregular number of rows and/or columns. For example, the array 11 can have an unequal number of rows and/or columns, where some columns have less or more rows than other columns or where some rows have less or more columns than other rows. A more specific example would be an array having three columns with only two rows and two columns with three rows. The electronic game controller 4 will transmit signals to the display screen 7 to cause the base game 8 and feature game 9 to be played on the lower playing area 7*a*, including showing the game symbols 10, array 11 and other visible elements of the games.

The array 11 of the base game 8 defines predetermined symbol positions 13, in which the game symbols 10 appear. The symbol positions 13 are not visually marked by boundary lines and simply provide an area for the game symbols 10 to appear. However, it will be appreciated that in other embodiments, the symbol positions 13 are defined by visible boundary lines (to define "squares", "cells" or game positions) or other markings to define each respective area of the symbol positions.

The array 11 is arranged so that a player can select one or more predetermined "pay lines" 14 defined around the array, which correspond to combinations of the symbol or game positions 13. The pay lines 14 correspond to the lines selected by the player and generally comprise at least one game position or symbol position 13 from each reel 12. The number of pay lines 14 that can be selected by the player depends on the amount of the monetary bet for playing a game on the array 11. In the base game 8, predetermined winning combinations of randomly selected game symbols 10 result in the award of prizes to the player.

The game symbols 10 can include a mixture of picture symbols (such as animal symbols or playing card symbols), word symbols, scatter symbols, substitute or wild card symbols and trigger symbols. Those skilled in the art will readily understand that a substitute symbol is able to act as any other game symbol, and hence is also known as a "wild card" symbol. Likewise, those skilled in the art will readily understand that a scatter symbol is a symbol that triggers a game event or confers an award without having to appear on a player-selected pay line 14. Similarly, a trigger symbol is a symbol that triggers a game event (like activating a feature game) or confers an award, where the trigger symbol may or may not have to appear in combination and may or may not have to appear on the same player-selected pay line 14. In this embodiment, the game symbols 10 include standard game symbols 10*a*, substitute or wild card symbols 10*b* and a scatter symbol in the form of a "Showgirls" symbol 10*c*. The electronic game controller 4 randomly determines the appearance of the game symbols 10 on the array 11.

Figure 7:
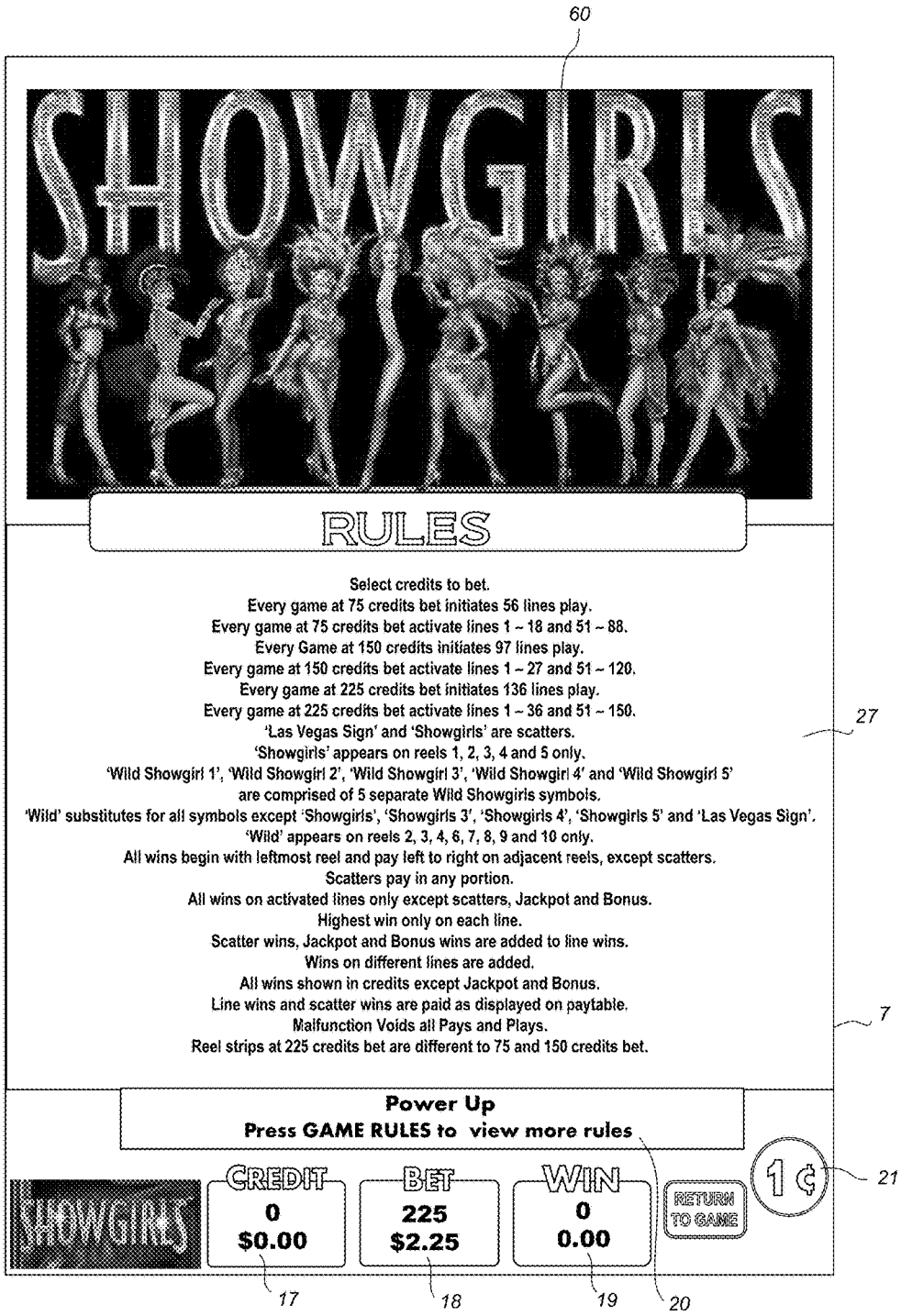
FIG. 7 is a simulated screen shot illustrating a rules screen displayed on the display of the electronic gaming machine of FIG. 1.
Figure 8:
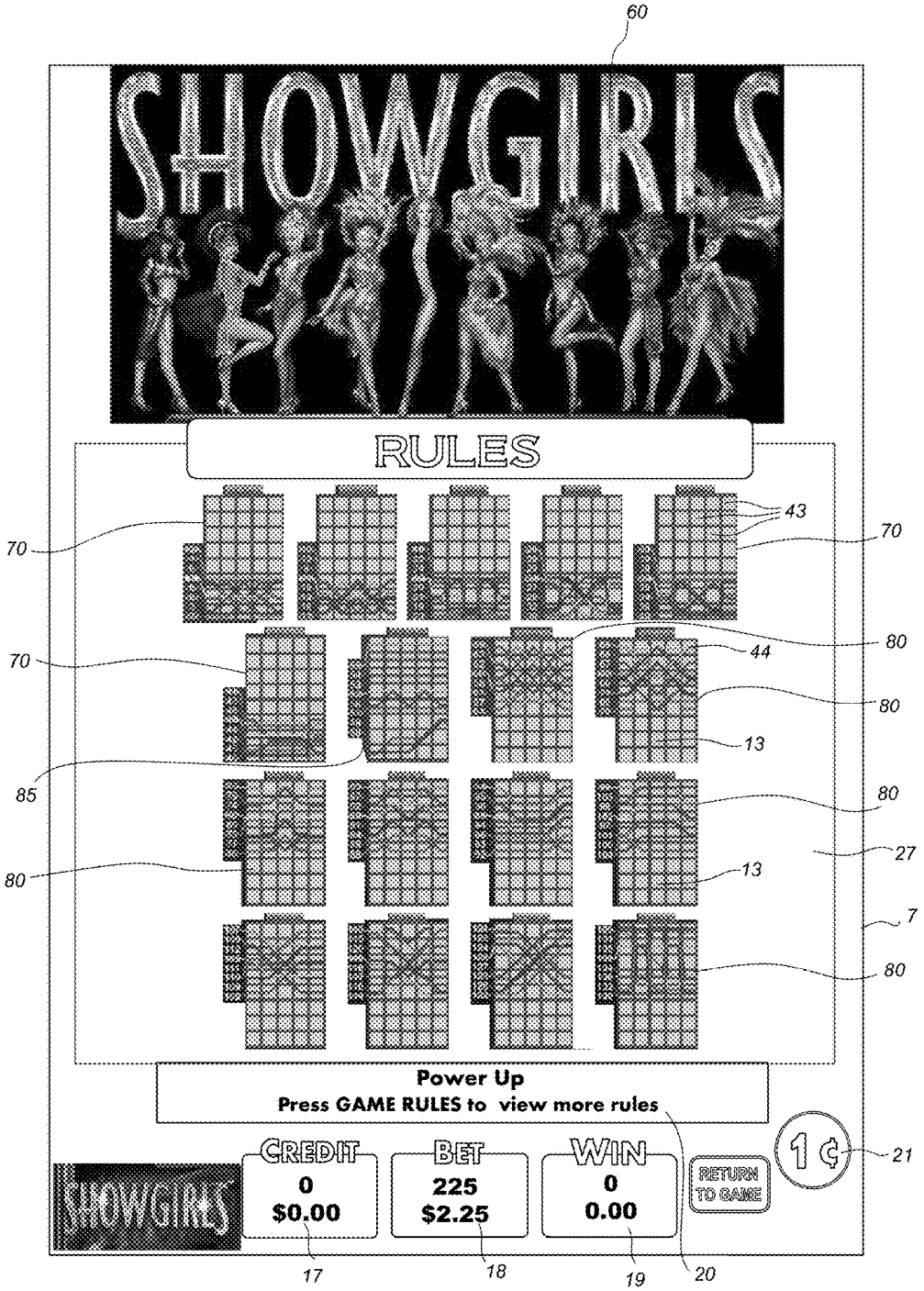
FIG. 8 is a simulated screen shot illustrating a rules screen showing some of the pay lines for the base game and feature game as displayed on the display of the electronic gaming machine of FIG. 1.

The lower playing area 7*a* of the video screen 7 also displays other standard game information including the amount of player credits 17, the amount of the current bet wagered by the player 18, the amount of wins by the player 19, a message area 20, a current denomination button 21 indicating the currently selected base bet denomination, the name 22 of the game "Showgirls" being played. Other standard information may also include the number of pay lines available 25, the number of player-selected pay lines 26 and a menu button for bringing up a menu screen 27 (typically explaining the game rules and showing the available pay lines 14, as best shown in FIGS. 7 and 8).

In the base game 8, the player initially makes a bet using vending slots 5 to initiate play of the electronic gaming machine 1 by building up credit to play the base game 8 on the electronic gaming machine. For example, the player can bet or wager monetary amounts equivalent to a particular amount of credits, depending on the bet denomination selected for the base game. Also, the player can make any additional side bets or ante-bets during play of the base game 8 once the base game has commenced to access additional features in the base game, such as increasing the number of winning combinations in the base game.

Typically, electronic gaming machines offer a number of preset bet options that the player can make, and these bet options can vary depending on the game or games offered on the electronic gaming machine. For example, a game on an electronic gaming machine may provide bet options of 1 credit, 2 credits, 5 credits and 10 credits per player-selected pay line 14. In another example, the player may bet 1 credit, 2 credits, 5 credits and 10 credits for a preset group or combination of pay lines 14, such as a group of 5 pay lines, 10 pay lines, 20 pay lines, etc. In this embodiment, three bet options are offered by the electronic gaming machine 1—a bet of 75 credits, 150 credits and 225 credits. The bet option selected determines the number of pay lines 14 that become payable in the game. The bet option of 75 credits permits the player to play 56 pay lines, the bet option of 150 credits permits the player to play 97 pay lines and the bet option of 225 credits permits the player to play 136 pay lines.

The electronic gaming machine 1 also has a default bet denomination, which is usually the bet denomination that was previously used in the preceding play of the base game 8. For example, if a person had played the base game 8 with a bet denomination of 5¢, then this would be the default bet denomination for the player when he or she commences play of the game. Where the electronic gaming machine has not yet been played or has been started up, the default bet denomination is initially selected by the electronic game controller 4. The default bet denomination can be randomly selected or chosen according to a predetermined order. Usually, the electronic game controller 4 will select the bet denomination with the lowest value that is available for the base game 8, which would be the 1¢ bet denomination for this embodiment. The player may change the bet denomination at any time in the base game 8 by touching the denomination button 21 before or after the reels 12 have spun. In this embodiment, touching the denomination button will bring denomination images that the player may select to quickly change the bet denomination between plays of the game 8.

As best shown in FIG. 3, the video display screen 7 may also include an upper display area 7*b*, which in this embodiment displays for the base game 8 a game banner with the game name 25 and a message area 28. Also displayed are special substitute or wild symbols 30, which are inactive in the base game 8 and are shown only for display purposes. The message area 28 advises the player of a trigger event that will activate at least one of the special substitute symbols 30 in the feature game 9.

Once the player has made a bet to commence play of the game 8, the electronic game controller 4 then transmits a signal to the display 7 to make reels 12 to appear to visibly rotate or "spin" in a linear path, typically in a downward vertical direction, and randomly display the game symbols 10 in each symbol position 13 for each play of the array 11 for the base game 8. After the reels 12 stop spinning, the electronic game controller 4 determines whether there are any predetermined winning combinations of the game symbols 10 appearing in any player-selected pay lines 14, such as a two of a kind, three of a kind, four of a kind or five of a kind for all the game symbols 10. Where playing card symbols are optionally used, other predetermined winning combinations include poker-based combinations of a "full house", "straight" or "flush". It will be appreciated that other winning combinations of game symbols 10 can also be provided. If so, the gaming machine 1 enters a winning game state and awards a prize according to the displayed predetermined winning combination.

The electronic game controller 4 also determines whether the feature game 9 should be activated, based on a predetermined trigger event, which in this embodiment is the appearance of at least three Showgirls scatter symbols 10*c* in a play or spin of the base game 8. The scatter symbols 10*e* need not appear on the same pay line 14, but can appear on any of the player-selected pay lines.

Figure 4:
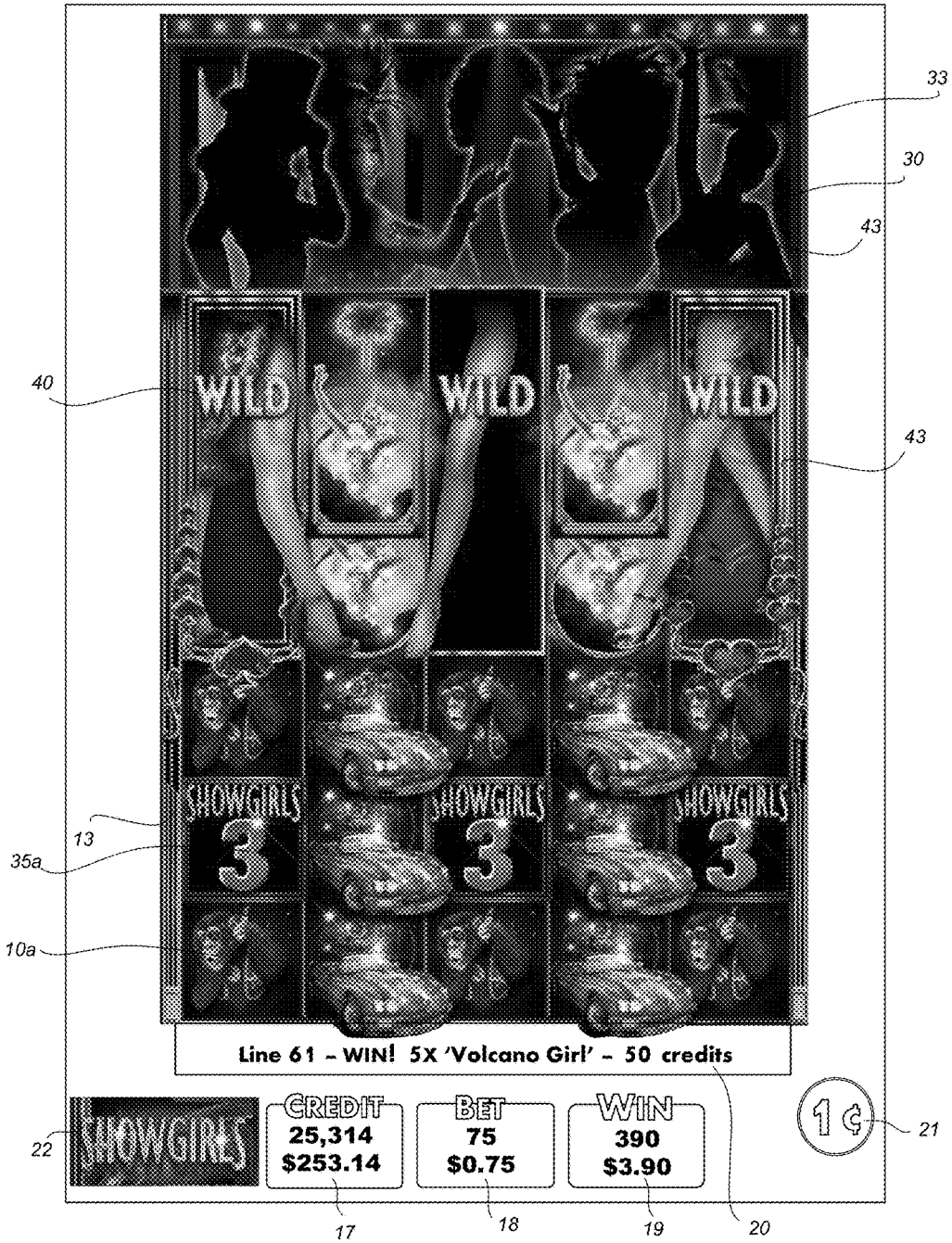
FIGS. 4 to 6 are simulated screen shots illustrating a feature game played on the display of the electronic gaming machine of FIG. 1.
Figure 5:
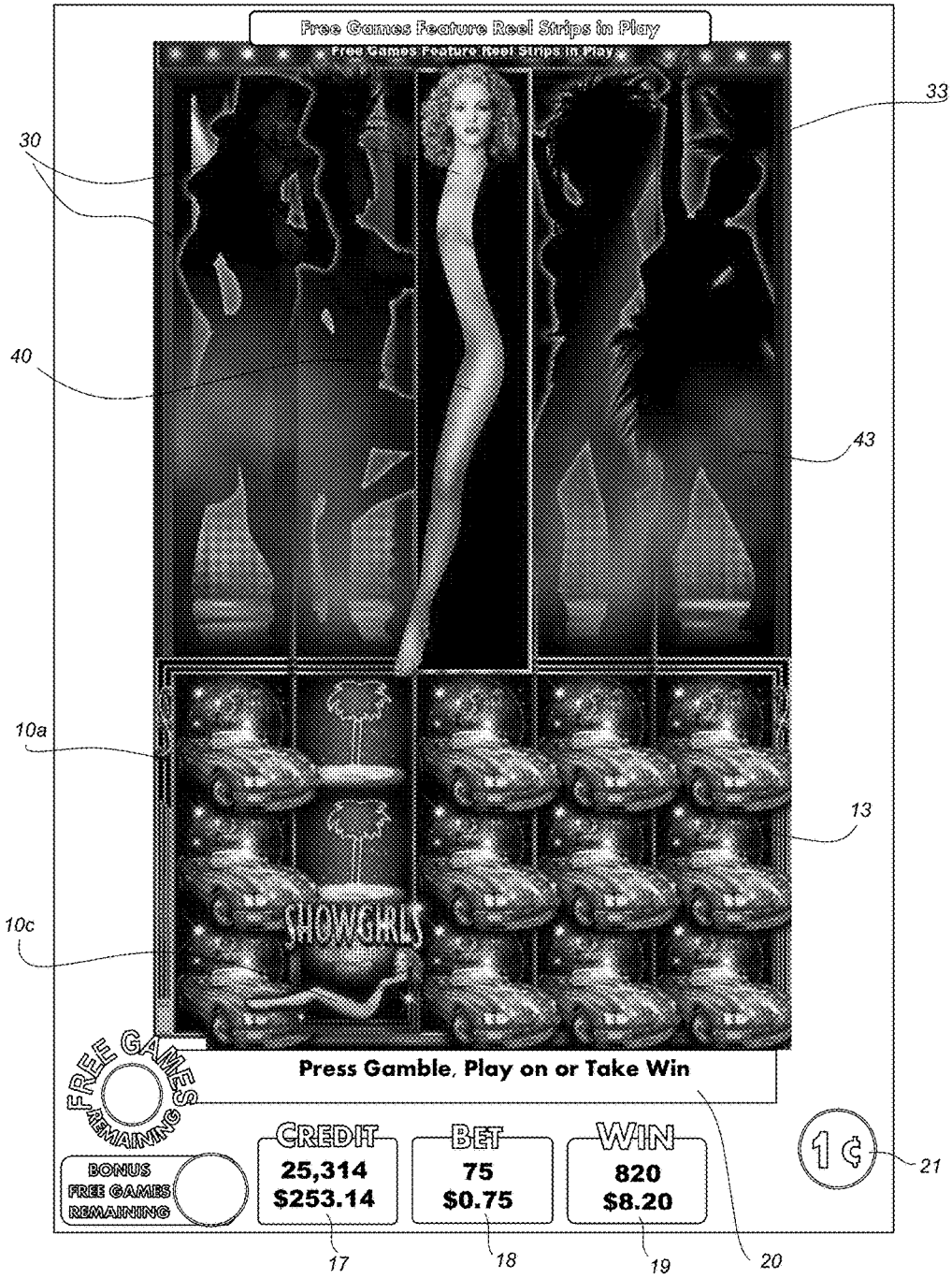
Figure 6:
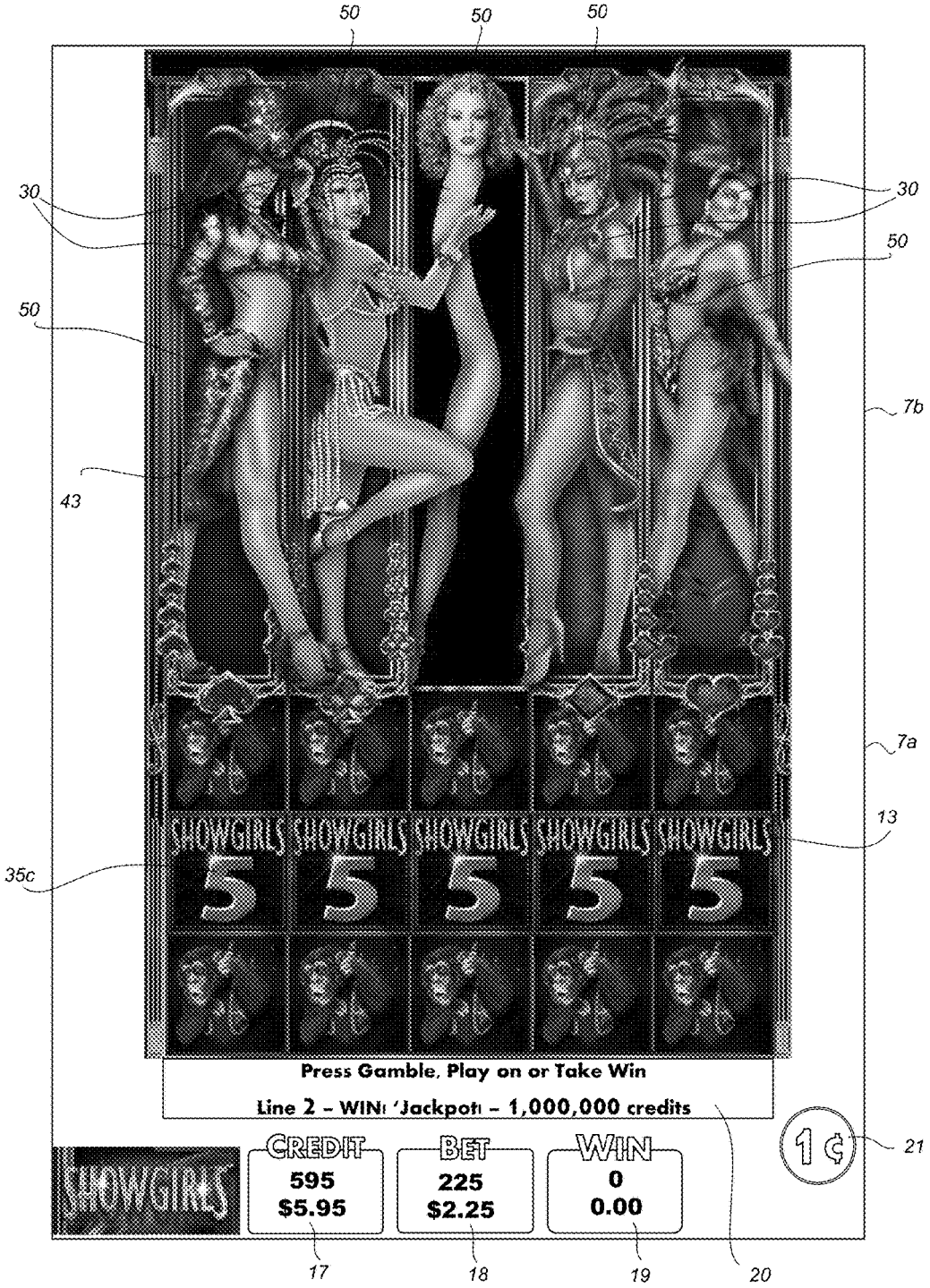

The electronic game controller 4 then transmits a signal to the video screen 7 to cause the feature game 9 to appear on the video screen 7, as best shown in FIGS. 4 to 6. The feature game 9 also uses the same game symbols 10 as the base game 8, as well as the same array 11, reels 12*a* to 12*e*, symbol positions 13 and player-selectable pay lines 14 on the video screen 7. In the feature game 9, the array is extended from the lower display area 7*a* to the upper display area 7*b* so as to display additional game symbols in the symbol positions 13 shown in the upper display area 7*b*. The extended array now comprises five additional rows to create an 8×5 array.

However, the symbol positions 13 in the extended portion of the array in the upper display area 7*b* only form additional pay lines 14 corresponding to the pay lines that are provided based on the bet option selected by the player. These additional pay lines 14 are new pay lines separate to the pay lines provided in the lower display area 7*a* in the base game 8 and the feature game 9. It will be appreciated that in other embodiments, some or all of the additional pay lines 14 include symbol positions 13 from the original array 11 in the lower display area 7*a*.

The feature game 9 awards ten free plays or spins of the feature game to the player without having to make an additional bet or wager. It will be understood by those skilled in the art that a free play or spin involves a play of the game without requiring any bet to be made by the player, and that any number of free spins can be chosen for the feature game. In addition, it will be appreciated that in the art free plays or spins are commonly referred to as "free games". The number of free games remaining in the feature game 9 may be indicated by a counter shown near the array 11 on the screen 7. Typically, the prizes awarded for the same winning combinations of game symbols in the feature game 9 are of higher value than the prizes awarded in the base game 8.

As stated above, the special substitute symbols 30 are now available for activation during play in the feature game 9. The special substitute symbols 30 are oversized symbols as they each occupy five symbol positions 13 of each reel 12 in the extended portion of the array 11 in the upper display area 7*b*. The special substitute symbols 30 are initially displayed in silhouette or hidden form 33 on the display 7 to indicate their inactive status.

In the feature game 9, the appearance of the Showgirls symbol 10*c* in a spin of the game results in one of three special trigger symbols 35 to be revealed underneath the Showgirls symbol 10*c*. This is visually shown by the Showgirls symbol 10*c* being visibly replaced with the special trigger symbol 35, either by being turned over to reveal the special symbol, or morphing or changing into the special symbol. These special trigger symbols 35 include a "Showgirls 3" symbol 35*a*, "Showgirls 4" symbol (not shown) and "Showgirls 5" symbol 35*c*. Depending on the bet option selected by the player, the number of symbol positions 13 displayed on the array 11 changes in response to the appearance of one or more of the special trigger symbols 35, which in this embodiment results in an increase in the number of symbol positions 13 displayed by adding new symbol positions 43 to the upper display area 7*b* that can display, in part or full, the oversized special substitute symbols 30. As a consequence, new pay lines 44 in the upper display area 7*b* become available and thus can form winning combinations of symbols, including the use of the special substitute symbols 30. The new pay lines 44 can either comprise only the new symbol positions 43 or a combination of new symbol positions 43 with existing symbol positions 13. Accordingly, the appearance of the special trigger symbols 35 can result in the partial or full activation of the special substitute symbols 30 in the new symbol positions 13 in the upper display area 7*b*.

The number of new symbol positions 43 that are added to the existing symbol positions 13 will depend on the selected bet option. This in turn limits how much of the special substitute symbol 30 can be revealed and be active in the feature game 9. Where the "Showgirls 3" symbol 35*a* appears, then the special substitute symbol 30 is active for three of its five symbol positions 43, as best shown in FIG. 4. This partial activation is visually indicated by partly revealing the image 40 of the special substitute symbol 30 for the three symbol positions while keeping the special substitute symbol in silhouette 33 for the two remaining symbol positions 43. Where the "Showgirls 4" symbol appears, then the special substitute symbol 30 is active for four of the symbol positions 13, and like the "Showgirls 3" symbol 35*a*, the partial activation is visually indicated by partly revealing the image 40 of the special substitute symbol 30 for the four symbol positions while keeping the special substitute symbol in silhouette 33 for the last remaining symbol position 13. Where the "Showgirls 5" symbol 35*c* appears, then the special substitute symbol 30 is active for all five symbol positions 43, as best shown in FIG. 5. This full activation is visually indicated by fully revealing the image 50 of the special substitute symbol 30 in the five symbol positions 43.

The frequency and appearance of the "Showgirls 3", "Showgirls 4" and "Showgirls 5" symbols 35*a* to 35*c* also depend on the bet option selected by the player. For example, selecting a base bet option of 75 credits will only make the "Showgirls 3" symbol 35*a* available in the feature game 9, whereas selecting the maximum bet option of 225 credits makes all three "Showgirls 3", "Showgirls 4" and "Showgirls 5" symbols 35*a* to 35*c* available in the feature game 9. In addition, the frequency of the "Showgirls 3", "Showgirls 4" and "Showgirls 5" symbols 35*a* to 35*c* also increases as the value of the of the selected bet option increases.

It should be noted that the partially or fully activated special substitute symbols 30 are located in the same reel as the special trigger symbols 35. For example, in FIG. 4 the "Showgirls 3" symbol 35*a* appears in reels 12*a*, 12*c* and 12*e*, and for those three reels, the partly activated special substitute symbol is shown partly revealed at 40 and partly in silhouette at 30. Likewise, in FIG. 5 the "Showgirls 5" symbol 35*c* has appeared in reel 12*c* only, and so the fully activated special substitute symbol 30 is shown with its image 50 revealed in reel 12*c* only, while the other special substitute symbols 30 are still hidden and shown in silhouette 33 in each of reels 12*a*, 12*b*, 12*d* and 12*e*.

FIG. 5 shows the occurrence of the special trigger event described in the message area 28 of FIG. 3. In this Figure, five Showgirls symbols 10*c* have appeared in each reel 12*a*, 12*b*, 12*c*, 12*d* and 12*e*. This has resulted in the "Showgirls 5" symbol 35*c* being revealed under each Showgirls symbol 10*c* in the reels 12*a*, 12*b*, 12*c*, 12*d* and 12*e*, and hence adding new symbol positions 43 in each of the reels to fully activate the special substitute symbols 30 in each reel, so that the full image 50 of each special substitute symbol 30 is shown in the symbol positions 43 of the now extended array 11 in the upper display area 7*b*. Thus, in this case, the player would receive the maximum prize for any pay lines 44 that are available in the extended portion of the array 11 in the upper display area 7*b*, since the special substitute symbol 30 is shown in each new symbol position 43, thus resulting in winning combinations of five of a kind for the highest value game symbol.

Referring to FIG. 8, the display screen 7 has a banner 60 of the game in the upper display area 7*b* while the menu screen 27 shows the standard pay lines 14 in array images 70 and some of the additional pay lines 44 in array images 80. The standard pay lines 14 exclusively use symbol positions from the standard 5×3 array 11 when in the base game 8, and are designated as "lines" 1 to 50. The additional pay lines 44 exclusively use the new symbol positions 43 that are added in response to the trigger event in the feature game 9, and are designated as "lines" 51 to 104. Lines 49 and 50 belonging to the standard pay lines 14 of the base game 8 and lines 51 to 56 belonging to the additional pay lines 44 of the feature game 9 are shown in the array image 85. The array images 70, 80 and 85 also illustrate the individual symbol positions 13, 43 present in the array 11 in both the base game 8 and the feature game 9.

In other embodiments, another type of pay line uses a combination of symbol positions 13 from the array 11 when used in the base game 8 and symbol positions 43 from the extended portion of the array 11 when triggered in the feature game 9.

As discussed above, depending on the bet option selected by the player, there are additional symbol positions 43 and additional pay lines 44 that are available, in which the activated special substitute symbol(s) 30 are used to form predetermined combinations in the additional pay lines 44 in the feature game 9 to award additional prizes and/or prizes of enhanced value for predetermined winning combinations appearing in those additional pay lines. In this embodiment, the bet option of 75 credits permits the player to play lines 1 to 18 and 51 to 88, the bet option of 150 credits permits the player to play lines 1 to 27 and 51 to 120, and the bet option of 225 credits permits the player to play lines 1 to 36 and 51 to 150. Thus, the player is able to access more additional pay lines 44 of the array 11 in the feature game 9 when selecting a bet option of higher value in terms of the amount of credits bet to play the base game 8. Accordingly, the array 11 changes or is different as different bet options are selected by the player in the sense that only certain pay lines 44 become available depending on the bet option that is selected. Thus, the use of selectable bet options that are linked or associated with additional symbol positions 43 and pay lines 44 encourages interest in the player as the player can observe a direct correlation between the numbers of symbol positions 43 and pay lines 44 and the selected bet option. This is correlation is enhanced by presenting the pay lines 44 in an array 11 that is different between bet options to spark the interest of the player and thus encourage the player to continue playing the same electronic gaming machine 1.

In some embodiments, a bet option of 75 credits only enables the player to play lines 1 to 50 for both the base game 8 and feature game 9 while a bet option of 150 credits enables the player to play lines 1 to 100. This means the array 11 comprises the industry standard of five reels 12*a* to 12*e* with three rows for one bet option while becoming different for the other bet option by having additional rows added to the reels 12*a* to 12*e*. Yet another embodiment provides tiered access based on the selected bet option to additional pay lines created by changing the array 11 into a different shape to accommodate more symbol positions 13. For example, a bet option of 10 credits allows a player to play pay lines associated with an industry standard 5×3 array, a bet option of 20 credits enables the player to play pay lines associated with the array changing to a 5×6 array, thus providing additional pay lines (via new symbol positions), and a bet option of 50 credits enables the player to play pay lines associated with the array now becoming a 5×9 array. In a further embodiment, a first bet option of 50 credits enables the player to play 50 pay lines dispersed across an industry standard 5×3 array (having a total of 15 symbol positions), a second bet option of 100 credits enables the player to play 100 pay lines dispersed across a 5×4 (i.e. five reels and four rows, having a total of 20 symbol positions) and a third bet option of 150 credits enables the player to play 150 pay lines dispersed across a 5×5 array (i.e. five reels and five rows, having a total of 25 symbol positions).

Furthermore, as stated in the rules screen 27 shown in FIG. 7, the reel strips used in the reels 12 for the bet option of 225 credits is different to the reel strips used in the reels 12 for the other two bet options of 75 and 120 credits. Thus, the reel strips used in the reels 12 for the bet option of 225 credits has a higher frequency of higher value game symbols (game symbols of high value and/or substitute symbols) and/or shows only high value game symbols in the reel strips, in order to increase the probability of the player obtaining a winning combination of game symbols and/or a prize of higher value awarded for a winning combination of higher value.

Figure 9A:
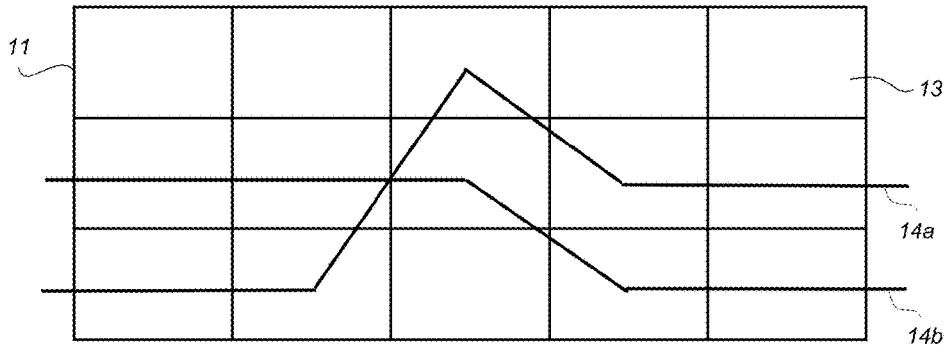
FIGS. 9*a*, 9*b*, 10*a* and 10*b* are drawings of arrays according to another embodiment of the invention.
Figure 9B:
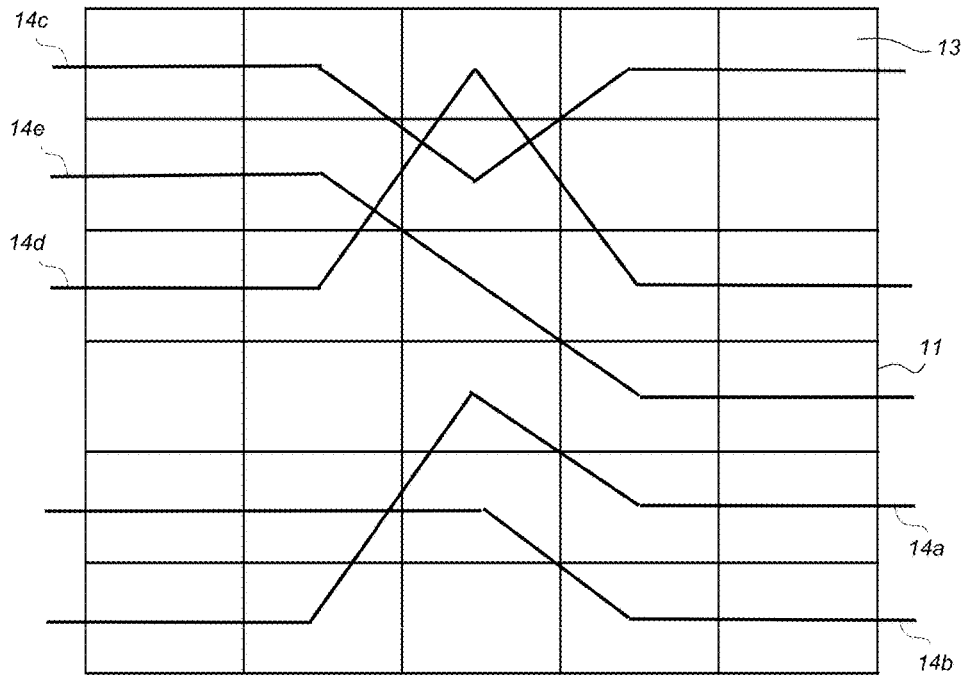

In another embodiment of the invention, the array used between different bet options is different in terms of the number of symbols positions used in the array. For example, a bet option of 75 credits uses an array 11 having 15 symbol positions 13, as best shown in FIG. 9*a*, whereas with a bet option of 150 credits uses the array 11 has 30 symbol positions 13, as best shown in FIG. 9*b*. The increased number of symbol positions would thus have a greater number of pay lines 14 that are available to the player, as the array 11 has pay lines 14*a* and 14*b* whereas the array has additional pay lines 14*c*, 14*d* and 14*e*. Pay lines 14*c* and 14*d* comprise symbol positions 13 that are not present in the array 11 of FIG. 9*a* while pay line 14*e* uses a combination of symbol positions 13 that are present in the array 11 of FIG. 9*a* and symbol positions that only exist in array 11 of FIG. 9*b*.

Figure 10A:
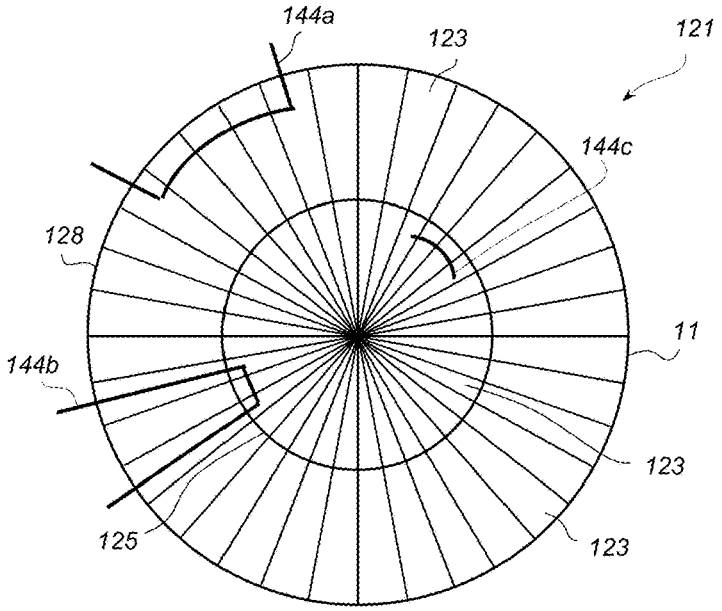
Figure 10B:
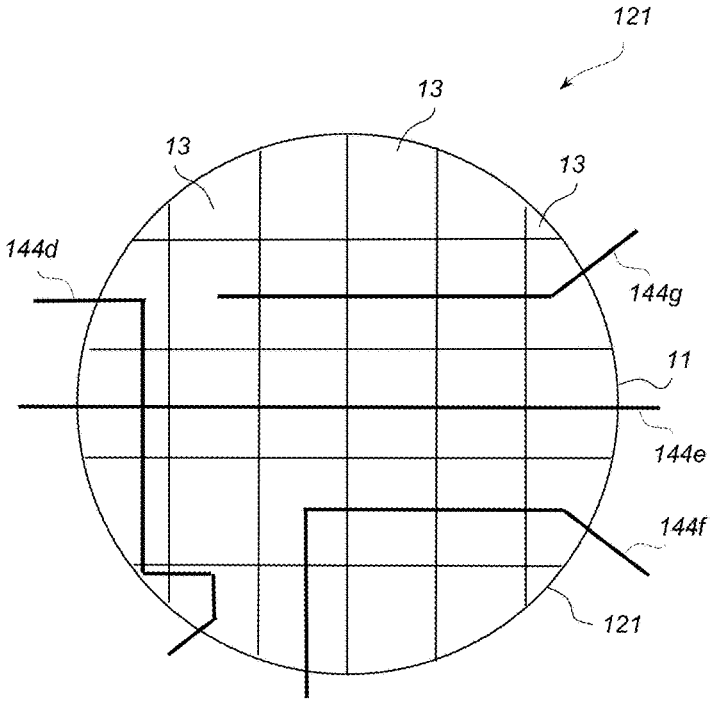

In other embodiments, the array has a different shape between selectable bet options, and thus enables different pay lines 14 to be used between different bet options. For example, a bet option of 75 credits uses an industry standard rectangular array of three rows and five columns, as best shown in FIG. 9*a*, while a bet option of 150 credits causes the array to morph into a circular shape 121 having thirty-two pie wedge portions or slices 123 comprising an inner ring 125 of 16 wedge portions and an outer ring 128 of 16 wedge portions, as best shown in FIG. 10*a*. Alternatively, thirty symbol positions 13 are arranged around the circular shape 121 of the array 11, as best shown in FIG. 10*b*. In another alternative, the array could comprise symbol positions 13 of the inner ring 125 for one bet option of 10 credits and then change into the circular shape 121 having inner and outer rings 125, 128 for a bet option of 20 credits. This results in different and/or an increased number of combinations of symbol positions (or pay lines) in the circular array compared to the rectangular array, such as the pay line 144*a* in the outer ring 128, pay line 144*b* in both the inner ring 125 and outer ring 128 and pay line 144*c* in the inner ring 125. Similarly, pay lines 144*d*, 144*e*, 144*f* and 144*g* defined in FIG. 10*b* are quite different to the possible pay lines in the array 11 of FIG. 9*a*, such as pay lines 14*a* and 14*b*. In particular, pay line 144*e* comprises six symbol positions 13, unlike the other pay lines 14*a*, 14*b*, 144*d*, 144*f* and 144*g*, which each comprise five symbol positions.

In yet a further embodiment, only some symbol positions in the array are used to form pay lines, while different symbol positions are used to form pay lines in another array.

In other embodiments, the game rules for one bet option are different to the game rules for another bet option. For example, the game rules for a bet option of 150 credits permit winning combinations of game symbols (say, two of a kind of a game symbol 10*a*) that are not winning combinations under the game rules for a bet option of only 75 credits.

In yet another embodiment, the pay table for predetermined winning combinations of game symbols displayed on the array for one bet option is different to the pay table for predetermined winning combinations of game symbols displayed on the array for another bet option. For example, the pay table for a bet option of 150 credits awards a prize of 500 credits for a five of kind of game symbol 10*a* whereas the pay table for a bet option of 75 credits only awards a prize of 200 credits for the same five of a kind combination.

In further embodiments, special symbols become available for display in same game depending on the selected bet option. For example, the special substitute symbol 30 may not be available for a bet option lower than 75 credits, such as 30 credits, and only becomes available for play in the feature game 9 when a threshold bet option of at least 75 credits is selected by the player.

In other embodiments, the electronic gaming machine 1 offers one or more jackpot or bonus prizes. Generally, the display screen 7 provides jackpot information relating to available jackpots or bonus prizes in the game 8. The upper display area 7*b* can ensure that the jackpot information is available to the player at all times during play of the electronic gaming machine 1.

The jackpot or bonus prizes may include progressive jackpots, fixed jackpots, mystery jackpots and symbol driven jackpots. A progressive jackpot prize takes a portion of each bet (typically a set percentage of each bet) made on the electronic gaming machine and thus the amount of the progressive jackpot incrementally increases as more bets are made on the electronic gaming machine 1. The progressive jackpot is typically awarded when a winning game combination associated with the jackpot occurs in the game played on the electronic gaming machine. In many cases, progressive jackpots are associated with the least probable winning combination and are commonly the highest paying award of the electronic gaming machine. In other cases, a separate trigger event can be used to award the progressive jackpot prize, such as a special jackpot symbol, a trigger event internally generated by the electronic game controller. Alternatively, or additionally, once a certain threshold is met, either a certain amount that has been bet on the electronic gaming machine or the incremented amount of the progressive jackpot, a trigger event is activated in the electronic gaming machine to pay out the progressive jackpot prize. Progressive jackpot prizes also tend to be shared amongst multiple electronic gaming machines so as to increase the amount of the progressive jackpot prize and hence increase player interest in playing one of the electronic gaming machines. In some electronic gaming machines, more than one jackpot or progressive jackpot is offered by the electronic gaming machine or electronic gaming machines linked together.

The jackpot or bonus prizes may also be mystery jackpots rather than symbol driven jackpots. That is, none of the symbols in the game trigger the jackpot; hence the trigger event is a "mystery". By way of comparison, a standard jackpot is typically symbol driven in that a particular combination of symbols must occur in the game to trigger the standard jackpot.

The trigger event for the mystery jackpot can be one randomly generated by the electronic game controller 4 for each play of the game 8. One way to implement the random determination of the trigger event is for the electronic game controller 4 to internally generate a random number and check if it is a predetermined number or within a predetermined range of numbers that will initiate the appearance of the trigger symbols. For example, the predetermined range of numbers could be the range of numbers between 1 and 10 and the electronic game controller 4 internally generates a random number between 1 and 100. If the generated number is any one of numbers 1 to 10, then this results in the electronic game controller 4 causing the trigger event to occur and award the progressive jackpot prize. It will be appreciated that this manner of determining the trigger event may also be used to determine whether the feature game 9 is triggered in the base game 8.

Progressive jackpots can be confined to the electronic gaming machine 1 as so called "standalone" progressive jackpots. Alternatively, the jackpot is a wide area or an in-house linked progressive jackpot prize. In other embodiments, one or more the progressive jackpot prizes are configured to be part of a wide area or in-house linked progressive jackpot prize. In other words, the progressive jackpot prizes can be awarded on a group of networked gaming machines in a specified area or a group of specified electronic gaming machines that are linked together for jackpot purposes (usually via a central jackpot controller). The jackpot prizes can also be shared with any other games offered on the same electronic gaming machine 1 (as in multi-game gaming machines).

During play of the base game 8 and/or feature game 9, the electronic game controller will determine whether a trigger event for any of the selected jackpots has occurred, as described above. In response to the occurrence of the jackpot trigger event(s), the electronic game controller 4 transmits a signal to the video screen 7 to cause the jackpot(s) associated with the jackpot trigger event(s) to be awarded to the player. After the jackpot(s) are awarded, their values are reset and game play of the electronic gaming machine 1 continues as before. The values of the jackpots that have been won can be reset either to a predetermined start value or simply increment upwardly from zero where the won jackpot is a progressive jackpot.

In addition, contributions of portions of the bet made to play the game are only made for the selected jackpots that are active. In this way, the player's bets do not contribute towards jackpots that the player cannot win.

While, the preferred embodiment has been described as using the appearance of a special trigger symbol as an in-game trigger event to activate the display of the symbol positions only associated with the selected bet option and thus the additional pay lines, it will be appreciated that in other embodiments the in-game trigger event can take other forms. For example, the electronic game controller 4 can randomly generate the in-game trigger event as described above in relation to triggering a mystery jackpot. In another example, the special symbol can appear outside the array 11 on the display 7 and need not appear in a symbol position 13 of the reels 12.

In other embodiments, the in-game trigger event is determined at the end or during the play of the game; i.e. at the end or during a spin of the reels 12. In some embodiments, the in-game trigger event occurs in a preceding play of the game so that the array 11 only displays the symbol positions 13 associated with a selected bet option in a subsequent play of said game, typically the next play of the game after said preceding play but could include a later successive play of the game.

In other embodiments, the electronic gaming machine 1 also offers the player the opportunity to play in community games against other players in so-called tournament games, or even in player versus player games. This is typically implemented by electronically linking several electronic gaming machines 1 in a group within a gaming venue. The player versus player or tournament game can be played simultaneously by the players or can be staggered, with some players playing at one time and some players playing at another time in the same game. In this situation, the player versus player or tournament game comprises the award of an additional bonus prize in addition to the jackpot prizes in said selected available jackpot set.

It will be appreciated that in other embodiments, game enhancing elements can be awarded in the feature game 9 in addition or as an alternative to the enhanced prizes awarded based on winning combinations of game symbols. The award of game enhancing elements can be done by way of a sixth reel or the appearance of game enhancing symbols in the reels 12*a* to 12*e*. A variety of game enhancing elements can be awarded by the game enhancing symbols, including:

i) symbols that award a predetermined number of free plays of said game, such as 8, 10 or 15 free spins or games;
ii) win multiplier symbols that multiply the amount of any win from one of said predetermined winning combinations;
iii) "wild" symbols that cause the display of substitute symbols in randomly selected symbol positions;
iv) bonus symbols that awards a bonus prize, either as a monetary amount or as a bonus credit;
v) wild multiplier symbols that cause the display of substitute symbols on the array 11 and multiplies the amount of any win from one of said predetermined winning combinations;
vi) bonus wild symbols that cause the display of substitute symbols on the array 11 and awards a bonus prize;
vii) symbols that cause the award of additional free plays of said game;
viii) symbols that cause one or more of said symbol positions to be held static (typically one or more reels 12*a* to 12*e*) and display substitute symbols on the array 11;
ix) symbols that cause the same game symbol to be stacked in a group of symbol positions, typically the group being one or more reels 12*a* to 12*e;*
x) symbols that cause the display of new game symbols on the array 11;
xi) "reveal" symbols that cause a game symbol to reveal another game symbol;
xii) "replacement" symbols that cause one or more game symbols to be replaced by other game symbols in the array 11;
xiii) bonus prize of 5×bet, 10×bet or 25×bet (the total amount of the bet or credits bet per pay line);
xiv) all royal card symbols change to wilds (substitute symbols) on reels 2, 3 and 4 of the array 11;
xv) all picture symbols change to wilds on reels 2, 3 and 4 of the array 11;
xvi) all symbols on reels 2 and 4 of the array 11 change to wild symbols; and
xvii) all symbols on reels 1 and 5 of the array 11 change to wild symbols.

These game enhancing symbols do not modify the function or value of the game symbols 10 that appear on the array 11, but instead confer bonus prizes, free games or change existing game symbols for other game symbols (such as replacing picture, royal card or symbols belonging to a reel with wild/substitute symbols). Where the function of game symbols 10 have been changed or the game symbols 10 are replaced, then this modification can take effect with the next play of the game instead of applying to the result of the spun array 11. In another embodiment, the game enhancing symbols may indicate the duration in which its game enhancing element is applied, such as a predetermined number of spins or a predetermined time period.

In other embodiments, the game enhancing symbols include "collector"-type game enhancing symbols which award points or tokens. The collection of points or tokens during the base game 8 and/or feature game 9 leads to the trigger of additional prizes or game enhancing symbols, depending on the number of points or tokens that are collected. These additional prizes can include stand alone progressive jackpots, bonus prizes and super games, which are enhanced versions of free spins or games where there are greater pay outs or frequency of wins.

While the same game format is essentially used across the base game 8 and feature game 9, it will be appreciated that the game format may vary across the base and feature games, as well as between base games where more than one game is offered by the same electronic gaming machine 1. For example, one of the games 8 may be a wheel-type game or a four reel game and another of the games may be a standard five reel game. Similarly, the games 8 may each have different game symbols, game rules and pay tables that are unique to each game.

While one embodiment of the invention has been described in relation to a base game 8 and a feature game 9, it will be appreciated that the invention could include one or more additional feature games that are triggered by specific trigger symbols appearing in the feature game 9. Also, the additional feature games may also have trigger symbols that trigger further feature games in a cascading fashion. These additional and further feature games could have the same game play elements as the feature game 9 or be different feature games entirely.

Furthermore, the embodiments of the invention have been described as providing a standard 5×3 set of reels 12 for the base game 8. However, it will be appreciated that in other embodiments, the size and shape of the reels 12 may vary for both the base game 8 and the feature game 9. For example, the array 11 could take any number of different shapes, such as triangular, circular, square, hexagonal, hemi-spherical or other non-rectangular or polygonal shapes. In another example, where the array is circular, the symbol positions 13 can take the form of pie-shaped slices or wedges. Alternatively, the array 11 could have an unequal number of rows and/or columns. For example, the reels 12*a*, 12*b* could have three rows, but the reels 12*c* to 12*e* could have four rows.

In other embodiments, the base game 8 (and the feature game) need not be displayed on a single video screen 7. Instead, they may be displayed on separate video screens, with the lower playing area 7*a* appearing in a lower video screen and the upper display area 7*b* on an upper video screen. Also, the order can be reversed, with the playing area 7*a* appearing on an upper video screen or upper part of a single video display screen 7 and the display area 7*b* appearing on a lower video screen or lower part of a single video display screen.

In another embodiment, the video screen 7 is a touch screen for use in addition to the player-actuatable buttons 6 so as to enable the player to select the bet level (such as bet denominations or bet per pay line 14) as well as other various features, such as making monetary bets for the game, initiating play of any base and feature games played and responding to any messages or requests issued on the electronic gaming machine 1 by the electronic game controller 4. In this case, the player may control when the reels 12 start spinning and stop spinning, either individually or collectively, by simply touching the reels 12. Control over spinning of the reels 12 can also be implemented through the buttons 6 on the console 3. This increases player interaction and provide the player with an opportunity to guess when a particular game symbol 10 may appear in the reels 12.

Figure 11:
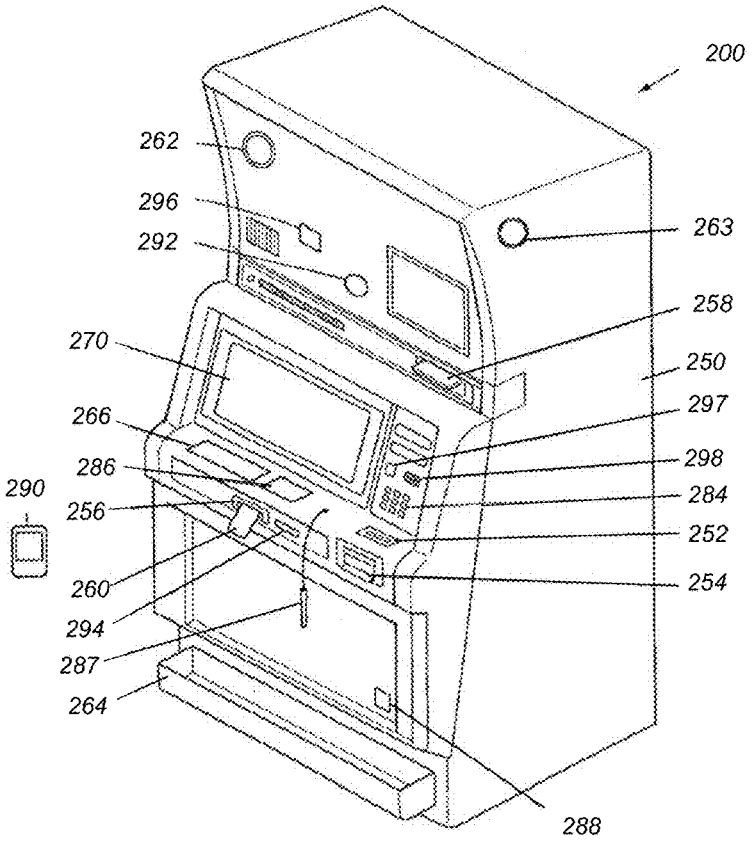
FIG. 11 is a perspective view of an electronic gaming machine according to a further embodiment of the invention.

Referring to FIG. 11, another embodiment of the invention is shown in the form of an electronic gaming machine 200. The electronic gaming machine 200 may include a housing or cabinet 250 and one or more value transfer mechanisms or devices, which may include a coin slot or acceptor 252, a paper currency or bill acceptor 254, a ticket reader/printer 256 and a card reader 258, which may be used to input value to the electronic gaming machine 200. A value transfer device may include any device that can accept value from a player.

If provided on the electronic gaming machine 200, the ticket reader/printer 256 may be used to read and/or print or otherwise encode ticket vouchers 260. The ticket vouchers 260 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 260 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 260 could be printed with an optically readable material such as ink, or data on the ticket vouchers 260 could be magnetically encoded. The ticket reader/printer 256 may be provided with the ability to both read and print ticket vouchers 260, or it may be provided with the ability to only read or only print or encode ticket vouchers 260. In the latter case, for example, some of the electronic gaming machines 2000 may have ticket printers 256 that may be used to print ticket vouchers 260, which could then be used by a player in other electronic gaming machines 200 that have ticket readers 256.

If provided, the card reader 258 may include any type of card reading device, such as a magnetic card reader or an optical card reader, and may be used to read data from a card offered by a player, such as a credit card or a player tracking card. If provided for player tracking purposes, the card reader 258 may be used to read data from, and/or write data to, player tracking cards that are capable of storing data representing the identity of a player, the identity of a casino, the players gaming habits, etc.

The electronic gaming machine 200 may include one or more audio speakers 262, a coin payout tray 264, an input control panel 266, and a color video display unit 270 for displaying images relating to the game or games provided by the electronic gaming machine 200. The audio speakers 262 may generate audio representing sounds such as the noise of spinning reels, a dealers voice, music, announcements or any other audio related to a game. The input control panel 266 may be provided with a plurality of pushbuttons or touch-sensitive areas that may be pressed by a player to select games, make wagers, make gaming decisions, etc.

Figure 12:
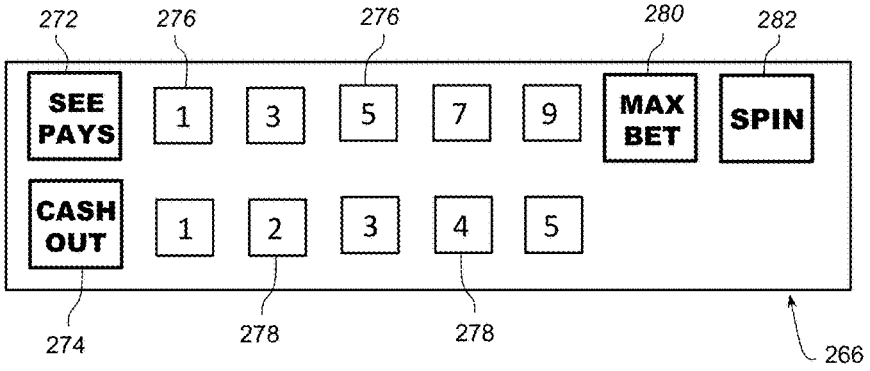
FIG. 12 is a schematic drawing of a control panel for the electronic gaming machine of FIG. 11.

FIG. 12 illustrates one possible embodiment of the control panel 266, which may be used where the electronic gaming machine 200 having a plurality of reels. The control panel 266 may include a "See Pays" button 272 that, when activated, causes the display unit 270 to generate one or more display screens showing the odds or payout information for the game or games provided by the electronic gaming machine 200. As used herein, the term "button" is intended to encompass any device that allows a player to make an input, such as an input device that must be depressed to make an input selection or a display area that a player may simply touch. The control panel 266 may include a "Cash Out" button 274 that may be activated when a player decides to terminate play on the electronic gaming machine 200, in which case the electronic gaming machine 200 may return value to the player, such as by returning a number of coins to the player via the payout tray 264.

The control panel 266 may be provided with a plurality of selection buttons 276, each of which allows the player to select a different number of pay lines prior to spinning the reels. For example, five buttons 276 may be provided, each of which may allow a player to select one, three, five, seven or nine pay lines.

The control panel 266 may also be provided with a plurality of selection buttons 78 each of which allows a player to specify a wager amount for each pay line selected. For example, the electronic gaming machine 200 may be provided with five selection buttons 78, each of which may allow a player to select 10, 20, 50, 100 and 200, to wager for each pay line selected. In that case, if a player were to activate one of the buttons 276 to select five pay lines and then activate one of the buttons 278 to select 50 per pay line to be wagered or bet, the total wager would be $0.25.

The control panel 266 may include a "Max Bet" button 280 to allow a player to make the maximum wager allowable for a game. In the above example, where up to nine pay lines were provided and up to 20¢ could be wagered for each pay line selected, the maximum wager would be $1.80 The control panel 266 may include a spin button 282 to allow the player to initiate spinning of the reels after a bet has been made.

In FIG. 12, a rectangle is shown around the buttons 272, 274, 276, 278, 280, 282. It should be understood that the rectangle simply designates, for ease of reference, an area in which the buttons 272, 274, 276, 278, 280, 282 may be located. Consequently, the term "control panel" should not be construed to imply that a panel or plate separate from the housing 250 of the electronic gaming machine 200 is required, and the term "control panel" may encompass a plurality or grouping of player activatable buttons.

Although one possible control panel 266 is described above, it should be understood that different buttons could be utilized in the control panel 266, and that the particular buttons used may depend on the game or games that could be played on the electronic gaming machine 200. Although the control panel 266 is shown to be separate from the display unit 270, it should be understood that the control panel 266 could be generated by the display unit 270. In that case, each of the buttons of the control panel 266 could be a colored area generated by the display unit 270, and some type of mechanism may be associated with the display unit 270 to detect when each of the buttons was touched, such as a touch-sensitive screen.

As noted above, the electronic gaming machine 200 may include a mechanism by which the electronic gaming machine 200 may determine the identity of the player. In particular, the card reader 258 may be used to read a card that carries an identification code that may be uniquely associated with the player so that the gaming unit can differentiate that player from all other players, or so that the gaming unit can differentiate that player as a member of a group of players from all player not a member of the group of players. The electronic gaming machine 200 may also include equipment, such as a keypad 284, an input pad 286 (with optional stylus 287), a port (or antenna) 288 adapted to communicate via a wired or wireless link (infrared or radio frequency link, for example) to a mobile electronic device 290 (such as a personal digital assistant, smart phone or tablet), a camera 292, a scanner 294, a retinal (or iris) scanner 296, fingerprint scanner 297, and/or a microphone 298. The electronic gaming machine 200 may include any one of the devices 258, 284, 286, 288, 290, 292, 294, 296, 297, 298, or the electronic gaming machine 200 may include a combination of some or all of the devices 258, 284, 286, 287, 288, 290, 292, 294, 296, 297, 298.

In operation, a player may identify him or herself to the electronic gaming machine 200 by entering a unique numeric or alpha-numeric code using the key pad 284, for example. Alternatively, the player may use his or her finger or the stylus 287 to sign his or her signature on the input pad 286. As a further alternative, the player may sign his or her signature on the mobile electronic device 290, which signature is then converted to electronic data, and the data is then transferred via the port/antenna 288 to the electronic gaming machine 200. As yet another alternative, the player may sign his or her signature on a piece of paper that is then photographed using the camera 292 or scanned using the scanner 294 (or the bill acceptor 254) to convert the signature into electronic data. As an additional alternative, the player may place one of his or her fingers or his or her hand on the scanner 297, and the scanner 297 may generate an electronic data representation of the fingerprint on one or more of the player's fingers or an electronic data representation of the pattern of the entire hand. Alternatively, the camera 292 may be used to take a picture (live or still) of the player, the picture then being converted into electronic data. As a still further alternative, the player may place his or her eye up to the retinal (or iris) scanner 296, and the retinal (or iris) scanner 296 may generate an electronic data representation corresponding to the pattern of the retina (or iris) of the player. As yet another alternative, the player may speak into the microphone 298, and characteristics of the spoken words (or voiceprint) may be converted into an electronic data representation.

Figure 13:
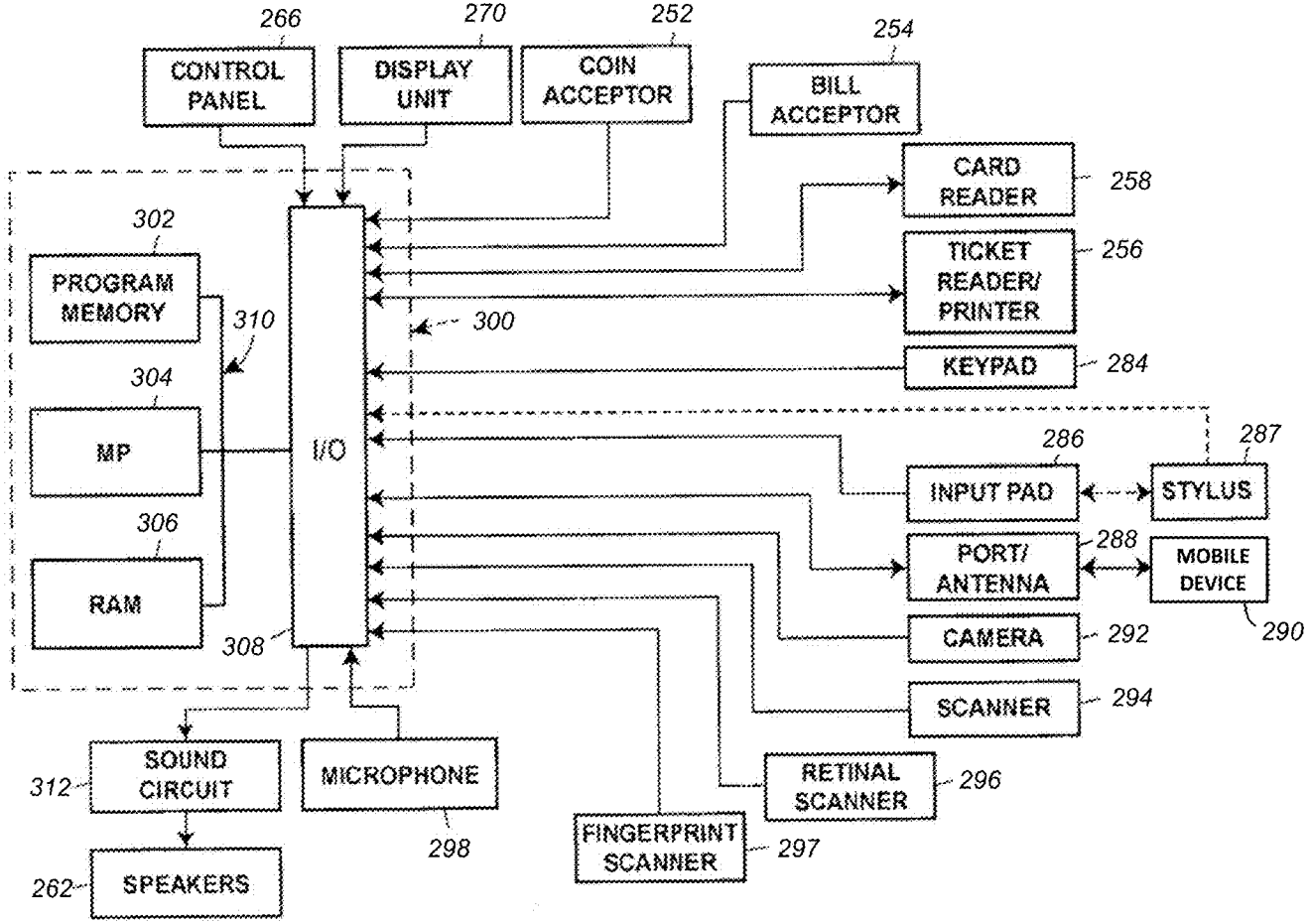
FIG. 13 is a block diagram of the electronic components of the electronic gaming machine of FIG. 11.

FIG. 13 is a block diagram of a number of components that may be incorporated in the electronic gaming machine 200. Referring to FIG. 13, the electronic gaming machine 200 may include a controller 300 that may comprise a program memory 302, a microcontroller or microprocessor (MP) 304, a random-access memory (RAM) 306 and an input/output (I/O) circuit 308, all of which may be interconnected via an address/data bus 310. It should be appreciated that although only one microprocessor 304 is shown, the controller 300 may include multiple microprocessors 304. Similarly, the memory of the controller 300 may include multiple RAMs 306 and multiple program memories 302. Although the I/O circuit 108 is shown as a single block, it should be appreciated that the I/O circuit 308 may include a number of different types of I/O circuits. The RAM(s) 304 and program memories 302 may be implemented as semiconductor memories, magnetically readable memories, and/or optically readable memories, for example.

FIG. 13 illustrates that the coin acceptor 252, the bill acceptor 254, the ticket reader/printer 256, the card reader 258, the control panel 266, the display unit 270, the keypad 284, the input pad 286 (and optionally the stylus 287), the port/antenna 288, the digital camera 292, the scanner 294, the retinal scanner 296, the fingerprint scanner 297 and the microphone 298 may be operatively coupled to the I/O circuit 308, each of those components being so coupled by either a unidirectional or bidirectional, single-line or multiple-line data link, which may depend on the design of the component that is used. The speaker(s) 262 may be operatively coupled to a sound circuit 312, that may comprise a voice- and sound-synthesis circuit or that may comprise a driver circuit. The sound-generating circuit 312 may be coupled to the I/O circuit 308.

As shown in FIG. 13, the components 252, 254, 256, 258, 266, 270, 284, 286, 287, 288, 292, 294, 296, 297, 298, 312 may be connected to the I/O circuit 308 via a respective direct line or conductor. Different connection schemes could be used. For example, one or more of the components shown in FIG. 13 may be connected to the I/O circuit 308 via a common bus or other data link that is shared by a number of components. Furthermore, some of the components may be directly connected to the microprocessor 304 without passing through the I/O circuit 308.

It will be appreciated that while the preferred embodiments have been described in relation to an industry standard electronic gaming machine, the invention can be readily applied to other types of electronic gaming machines, including a personal computer (standing alone or connected to a communications network, LAN or WAN), mobile electronic devices (such as handheld or portable electronic devices like tablets and smart phones) and other electronic devices capable of displaying a game. In the case of mobile electronic device, in one arrangement it may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. Similarly, either of the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In an alternative embodiment, the electronic gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the invention includes a computer programme configured to perform the invention. In this way the invention can be implemented in various ways on an electronic gaming machine. In a further aspect, the invention includes a gaming system configured comprising a central processing unit (such as a computer or computational processor) configured for communication with an electronic gaming machine to perform the invention. In a yet another aspect, the invention includes a non-transitory computer readable or carrier medium carrying computer executable code that, when executed on a central processing unit configured for communication with an electronic gaming machine, causes said central processing unit to perform the invention. In this case, the non-transitory carrier medium includes an external hard drive, a memory device, including a memory card, smart card, a radio frequency identification (RFID) device, USB key, magnetic card or other electronic storage device.

It will further be appreciated that any of the features in the preferred embodiments of the invention can be combined together and are not necessarily applied in isolation from each other. For example, the feature of the player being able to selectively starting or stopping spinning of the reels 12 and the feature of providing separate video screens for the lower playing area 7*a* and upper display area 7*b* can be combined into a single electronic gaming machine 1. Similar combinations of two or more features from the above described embodiments or embodiments of the invention can be readily made by one skilled in the art.

By providing at least two selectable bet options having different pay line combinations and a number of symbol positions displayed in an array that changes based on the selected bet option in response to an in-game trigger event, the invention provides a variety of game play that is not found in other standard electronic gaming machines and thus stimulates interest in a player. In addition, the player is able to customise game play on the electronic gaming machine to fit his or her comfort level in balancing the "risk vs. reward" in making bets of higher value for increasing the probability of obtaining winning combinations and/or prizes of higher value. All these advantages of the invention result in the player being more likely to retain interest in continuing to play the same electronic gaming machine. Furthermore, since the electronic game controller controls operation of the electronic gaming machine, the invention can be readily implemented to existing gaming machines and other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An electronic gaming machine, comprising:

a display for displaying game symbols for playing a game, wherein said game comprises randomly displaying said game symbols in an array of symbol positions and awarding prizes to a player for predetermined winning combinations of game symbols to a player;

an electronic game controller in electronic communication with said display for controlling the appearance of game symbols in said game on the display; and a value transfer mechanism for receiving value from a player to make a bet and initiate play of said game on said display, said value transfer mechanism being in electronic communication with said electronic game controller and comprising at least one of a coin acceptor, a paper currency acceptor and a ticket reader;

wherein said electronic game controller in response to said player making a bet via said value transfer mechanism commences play of said game by randomly selecting game symbols and transmitting a signal to said display to display said randomly selected game symbols wherein said electronic game controller enables said player to select a bet option from a plurality of bet options for said game, each said bet option being associated with a number of predetermined combinations of symbol positions defined in said array;

wherein a first bet option is associated with a first number of predetermined combinations of symbol positions and a second bet option is associated with a second number of predetermined combinations of symbol positions, said first bet option being different to said second bet option and said first number being different to said second number; and wherein, in response to an in-game trigger event, said electronic game controller transmits a signal to said display so that the number of symbol positions displayed in said array changes based on the selected bet option.

2. The electronic gaming machine of claim 1, wherein the array comprises a plurality of reels, the number of symbol positions displayed in said array increases by the addition of new symbol positions to one of the plurality of reels on said display.

3. The electronic gaming machine of claim 2, wherein the number of new symbol positions associated with said first bet option is less than the number of new symbol positions associated with said second bet option.

4. The electronic gaming machine of claim 2, wherein one or more new predetermined combinations are formed on said array in addition to the predetermined combinations associated with said bet options, said one or more new predetermined combinations comprising one or more of said new symbol positions.

5. The electronic gaming machine of claim 2, wherein one or more new predetermined combinations are formed on said array in addition to the predetermined combinations associated with said bet options, said one or more new predetermined combinations comprising only said new symbol positions.

6. The electronic gaming machine of claim 1, wherein said first bet option has a value less than a value of said second bet option.

7. The electronic gaming machine of claim 1, wherein said first number of predetermined combinations of symbol positions that is less than said second number of predetermined combinations of symbol positions.

8. The electronic gaming machine of claim 1, wherein the number of symbol positions in said array for said first bet option is less than the number of symbol positions in said array for said second bet option.

9. The electronic gaming machine of claim 1, wherein, for at least one of said first and second bet options, each symbol position in said array is used in at least one predetermined combination of symbol positions.

10. The electronic gaming machine of claim 1, wherein the symbol positions of each said bet option are arranged in said array differently to the symbol positions in said array for the other bet options.

11. The electronic gaming machine of claim 1, wherein said array for said first bet option is different in shape to said array for said second bet option.

12. The electronic gaming machine of claim 11, wherein said array for one of said first and second bet options has a non-rectangular shape.

13. The electronic gaming machine of claim 1, wherein said array changes in shape in response to said in-game trigger event.

14. The electronic gaming machine of claim 1, wherein said array is solely used to play said game.

15. The electronic gaming machine of claim 1, wherein said array comprises symbol positions arranged into columns or reels associated with reel strips comprising game symbols for display on said reels, wherein at least one reel strip associated with said array is different to at least one reel strip associated with said array.

16. The electronic gaming machine of claim 15, wherein the reel strips associated with said array for said first bet option is different to the reel strips associated with said array for said second bet option.

17. The electronic gaming machine of claim 1, wherein the game rules for playing said array for said first bet option are different to the game rules for playing said array for said second bet option.

18. The electronic gaming machine of claim 1, wherein the pay table for predetermined winning combinations of game symbols displayed on said array for said first bet option is different to the pay table for predetermined winning combinations of game symbols displayed on said array for said second bet option.

19. The electronic gaming machine of claim 1, wherein special symbols become available for display in the same game depending on the selected bet option.

20. The electronic gaming machine of claim 1, wherein said in-game trigger event comprises the appearance of one or more special symbols on said array.

21. The electronic gaming machine of claim 1, wherein said in-game trigger event occurs in a preceding play of said game and said array changes the number of symbol positions based on said selected bet option in a subsequent play of said game.

22. The electronic gaming machine of claim 21, wherein said subsequent play is the play of the game after said preceding play.

23. The electronic gaming machine of claim 21, wherein said in-game trigger event is randomly determined by said electronic game controller at the end of said preceding play.

24. The electronic gaming machine of claim 21, wherein said in-game trigger event is randomly determined by said electronic game controller during said preceding play.

25. The electronic gaming machine of claim 2, wherein said in-game trigger event comprises an appearance of a special symbol on said array in said one of the plurality of reels.

* * * * *